US011839242B2

(12) United States Patent
Almog

(10) Patent No.: US 11,839,242 B2
(45) Date of Patent: Dec. 12, 2023

(54) CLOTHING ARTICLE HAVING TERRY CLOTH ADJACENT TO NON-TERRY CLOTH

(71) Applicant: Delta Galil Industries Ltd., Caesarea (IL)

(72) Inventor: Eli Almog, Zurit (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 295 days.

(21) Appl. No.: 17/499,922

(22) Filed: Oct. 13, 2021

(65) Prior Publication Data

US 2022/0030960 A1 Feb. 3, 2022

Related U.S. Application Data

(63) Continuation-in-part of application No. PCT/IL2020/050447, filed on Apr. 16, 2020.
(Continued)

(51) Int. Cl.
*A41C 3/14* (2006.01)
*A41C 3/10* (2006.01)
(Continued)

(52) U.S. Cl.
CPC ..... *A41C 3/144* (2013.01); *A41C 3/10* (2013.01); *A41D 27/13* (2013.01); *A41D 27/26* (2013.01);
(Continued)

(58) Field of Classification Search
CPC ..... A41C 3/144; A41C 3/10; A41D 27/13; A41D 27/26; A41D 2500/10; A41D 2500/52
See application file for complete search history.

(56) References Cited

U.S. PATENT DOCUMENTS 3,208,242 A 9/1965 Fors
6,324,874 B2 * 12/2001 Fujimoto ..... D04B 1/04 66/178 R
(Continued)

FOREIGN PATENT DOCUMENTS

CN 202566300 U 12/2012
DE 3938582 A1 5/1991
(Continued)

OTHER PUBLICATIONS

International Search Report in PCT/IL2020/050447, dated Jul. 21, 2020.
(Continued)

*Primary Examiner* — Gloria M Hale
(74) *Attorney, Agent, or Firm* — AlphaPatent Associates Ltd.; Daniel J. Swirsky

(57) ABSTRACT

A garment for a human wearer includes: a terry garment-region having terry-knit cloth; and a non-terry garment-region having non-terry-knit cloth. The terry garment-region is directly bordering and adjacent to the non-terry garment-region. The terry garment-region and the non-terry garment-region are a seamless continuation of each other. Similarly, a continuous fabric for making clothes includes: a terry fabric-region having terry-knit cloth, and an adjacent and immediately bordering non-terry fabric-region having non-terry-knit cloth. Optionally, TPU or PVC elements or plastic elements are embedded within the terry garment-region, or within the non-terry garment-region; or such elements cover, or are covered by, the terry garment-region or the non-terry garment-region.

31 Claims, 17 Drawing Sheets

Related U.S. Application Data

(60) Provisional application No. 62/835,504, filed on Apr. 18, 2019.

(51) Int. Cl.
*A41D 27/13* (2006.01)
*A41D 27/26* (2006.01)

(52) U.S. Cl.
CPC ..... *A41D 2500/10* (2013.01); *A41D 2500/52* (2013.01)

(56) References Cited

U.S. PATENT DOCUMENTS

| | | | | |
|---|---|---|---|---|
| 2004/0003629 | A1 | 1/2004 | Mitchell | |
| 2008/0189839 | A1 | 8/2008 | Lambertz | |
| 2013/0260104 | A1 | 10/2013 | Dua | |
| 2017/0035120 | A1* | 2/2017 | Ramsey | D04B 1/12 |
| 2018/0103783 | A1 | 4/2018 | Danaher | |
| 2022/0030960 | A1* | 2/2022 | Almog | D04B 1/243 |

FOREIGN PATENT DOCUMENTS

| | | | |
|---|---|---|---|
| EP | 2348902 | B1 | 4/2012 |
| EP | 2834067 | B1 | 5/2021 |
| WO | 2010/065324 | A1 | 6/2010 |
| WO | 2013/151987 | A2 | 10/2013 |
| WO | 2015/171363 | A1 | 11/2015 |

OTHER PUBLICATIONS

Written Opinion of the International Searching Authority in PCT/IL2020/050447, dated Jul. 21, 2020.

Machine Translation of DE 3938582 A1 Printed on May 23, 2023 from "Google Patents" at: https://patents.google.com/patent/DE3938582A1/en.

Machine Translation of CN 202566300 U Printed on May 23, 2023 from "Google Patents" at: https://patents.google.com/patent/CN202566300U/en.

* cited by examiner

CLOTHING ARTICLE HAVING TERRY CLOTH ADJACENT TO NON-TERRY CLOTH

CROSS-REFERENCE TO RELATED APPLICATIONS

This patent application is a Continuation-in-Part (CIP) of PCT international patent application serial number PCT/IL2020/050447, having an international filing date of Apr. 16, 2020, published as international publication number WO 2020/212988 A1, which is hereby incorporated by reference in its entirety; which claims priority and benefit from U.S. patent application No. 62/835,504, filed on Apr. 18, 2019, which is hereby incorporated by reference in its entirety.

FIELD

The present invention is related to the field of clothing.

BACKGROUND

Clothing articles and clothes are typically formed of textile material and are worn on the body. Clothes are worn for various purposes, for example, to keep the human body warm in a cold weather, to protect the human body from rough surfaces or insects or plants, to provide a hygienic barrier between the human body and the environment, to protect the human body from ultraviolet radiation, to cover genitals, for social reasons or as fashion, or the like.

SUMMARY

Some embodiments may comprise a clothing article having (i) a terry cloth region, which is adjacent to and/or integrally knit to and/or is immediately bordering and/or directly bordering with (ii) a non-terry cloth region. Some embodiments of the present invention may comprise a clothing article having (i) a terry region or a terry knit region, which is adjacent to and/or integrally knitted to and/or is immediately bordering with and/or is directly bordering with (ii) a non-terry knit region or a non-terry region.

In some embodiments, the two regions (terry, and non-terry) are adjacent to each other on the same plane; such that the terry cloth portion is a direct continuation of the non-terry cloth portion of the same article, and vice versa; thereby providing a single-layer garment which has one or more terry-cloth regions adjacent to (and not over, and not under) one or more non-terry cloth regions.

In some embodiments, a garment for a human wearer includes: a terry garment-region having terry-knit cloth; and a non-terry garment-region having non-terry-knit cloth. The terry garment-region is directly bordering and adjacent to the non-terry garment-region. The terry garment-region and the non-terry garment-region are a seamless continuation of each other. Similarly, a continuous fabric for making clothes includes: a terry fabric-region having terry-knit cloth, and an adjacent and immediately bordering non-terry fabric-region having non-terry-knit cloth. Optionally, TPU or PVC elements or plastic elements are embedded within the terry garment-region, or within the non-terry garment-region; or such elements cover, or are covered by, the terry garment-region or the non-terry garment-region.

Some embodiments may provide other and/or additional advantages and/or benefits.

DETAILED DESCRIPTION OF SOME DEMONSTRATIVE EMBODIMENTS

Figure 1A:
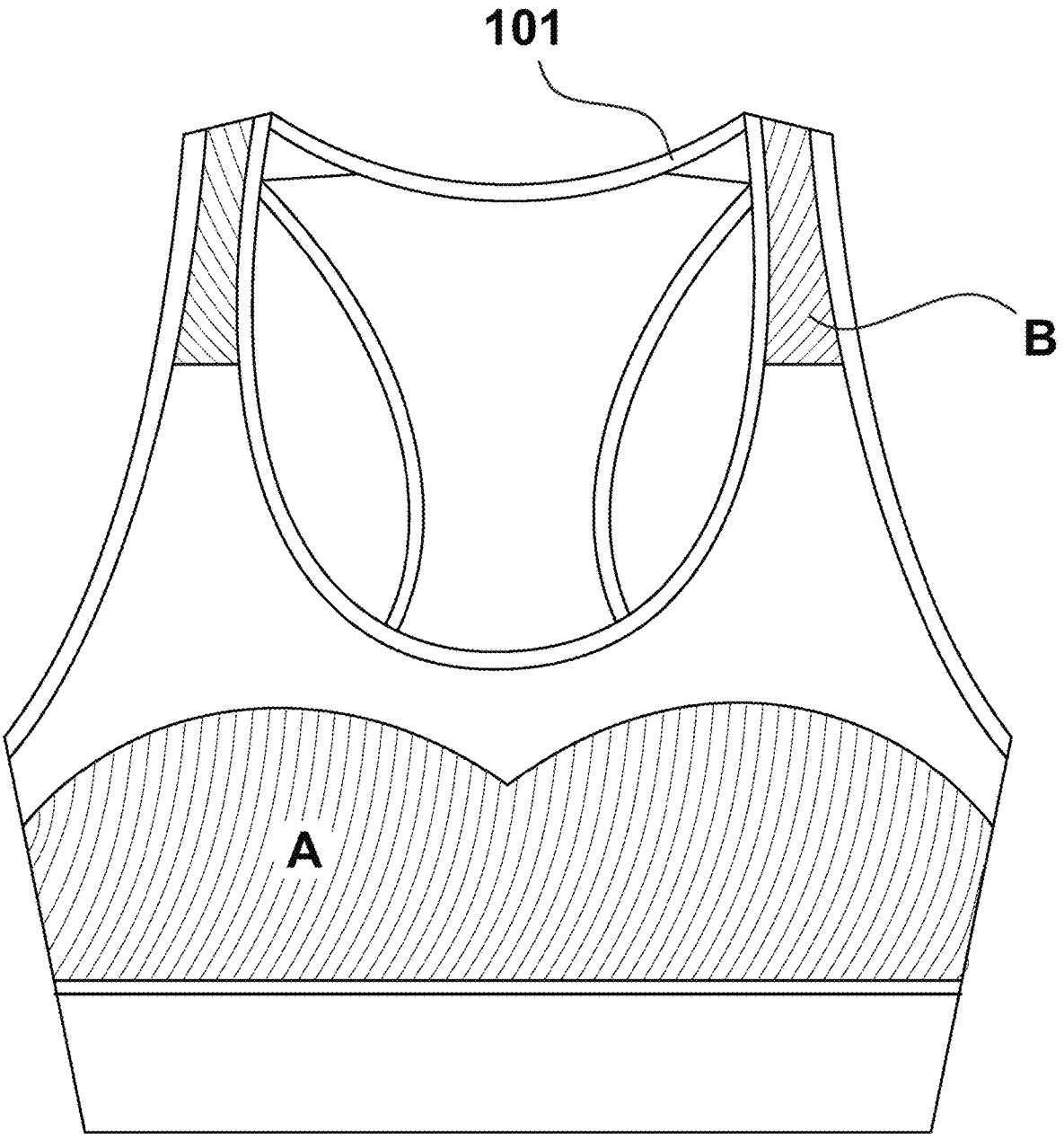
FIGS. 1A and 1B are schematic illustrations of front-view and back-view of a bra or sports bra, or other garment which covers or partially covers or supports the breasts of a female wearer, in accordance with some demonstrative embodiments of the present invention.

The Applicants have realized that a garment or a clothing article is typically formed, exclusively, of non-terry cloth or non-terry knitting.

The Applicants have also realized that some particular textile products, such as towels or bathroom towels or beach towels, are formed exclusively from terry cloth or terry knitting, in their entirety.

The Applicants have also realized that a bathrobe is a garment formed exclusively from terry cloth or terry knitting.

The Applicants have realized that there does not exist any conventional garment, intended to be worn by a human, which includes a unique combination of: (i) one or more terry cloth regions, that are bordering with or are adjacent to (ii) one or more non-terry cloth regions.

The present invention comprises a garment, or undergarment, or a clothing article, having a unique combination of terry cloth region(s) and non-terry cloth region(s), in the same single garment, next to each other or adjacent to each other, as a generally continuous fabric (e.g., not as a Patch that is glued or boned on top of another layer; not as a patch of terry cloth that is sewn or glued or bonded on top of non-terry cloth or under a non-terry cloth).

The unique combination of one or more terry cloth regions with one or more non-terry cloth regions, in the same single garment, may provide unique benefits or advantageous or functional contributions to the human wearer; for example: enabling to provide a unique feeling or look-and-feel; enabling to provide increased warmth or reduce warmth to specific body regions; enabling to provide increased level of support (or rigidity, or rigidness, or elasticity, or flexibility) or reduced level (or, gradually changing level of one or more of these properties) to different body regions or body parts; enabling to hide one or more body parts or body organs from protruding or otherwise showing (e.g., a terry cloth region may cover a nipple or a nipple area to better cover it and/or hide it from view); enabling a garment that provides to the human wearer a mixture or a combination of two or more friction levels (e.g., providing increased friction at the terry cloth region(s), relative to the level of friction provided by the non-terry cloth region(s) of the garment); enabling a garment that provides to the human wearer a mixture or a combination of two or more sweat absorption levels (e.g., providing increased sweat absorption level at the terry cloth region(s), relative to the level of sweat absorption provided by the non-terry cloth region(s) of the garment); enabling to create a garment that has unique visual properties due to the combination of terry cloth region(s) with (or adjacent to, or bordering with) non-terry cloth region(s); and/or providing other advantages or benefits.

In some embodiments, the garment may be formed using seamless knitting technology, such that terry region(s) and non-terry region(s) are knitted as a continuous unified product, wherein a terry region continues seamlessly (without a seam) and becomes non-terry region, and vice versa.

In some embodiments, the total area of the terry region(s) of the garment may be, for example: up to 99 percent of the entire area of the garment; or up to 90 percent of the entire area of the garment; or up to 75 percent of the entire area of the garment; or up to 66 percent of the entire area of the garment; or up to 60 percent of the entire area of the garment; or up to 50 percent of the entire area of the garment; or up to 33 percent of the entire area of the garment; or up to 25 percent of the entire area of the garment; or up to 20 percent of the entire area of the garment; or up to 15 percent of the entire area of the garment; or up to 10 percent of the entire area of the garment; or up to 5 percent of the entire area of the garment; or up to 3 percent of the entire area of the garment; or up to 1 percent of the entire area of the garment; or may be in the range of 3 to 33 percent of the entire area of the garment; or may be in the range of 5 to 25 percent of the entire area of the garment; or may be in the range of 5 to 15 percent of the entire area of the garment; or may be in the range of 10 to 25 percent of the entire area of the garment; or may be a majority of the area of the garment; or may be a minority of the area of the garment.

In some embodiments, the total area of the non-terry region(s) of the garment may be, for example: up to 99 percent of the entire area of the garment; or up to 90 percent of the entire area of the garment; or up to 75 percent of the entire area of the garment; or up to 66 percent of the entire area of the garment; or up to 60 percent of the entire area of the garment; or up to 50 percent of the entire area of the garment; or up to 33 percent of the entire area of the garment; or up to 25 percent of the entire area of the garment; or up to 20 percent of the entire area of the garment; or up to 15 percent of the entire area of the garment; or up to 10 percent of the entire area of the garment; or up to 5 percent of the entire area of the garment; or up to 3 percent of the entire area of the garment; or up to 1 percent of the entire area of the garment; or may be in the range of 3 to 33 percent of the entire area of the garment; or may be in the range of 5 to 25 percent of the entire area of the garment; or may be in the range of 5 to 15 percent of the entire area of the garment; or may be in the range of 10 to 25 percent of the entire area of the garment; or may be a majority of the area of the garment; or may be a minority of the area of the garment.

In some embodiments, the garment includes a single terry-cloth region, that is surrounded by non-terry fabric. In other embodiments, the garment includes two discrete (separate from each other) terry-cloth regions, each one of them surrounded by non-terry fabric. In other embodiments, the garment includes three discrete (separate from each other) terry-cloth regions, each one of them surrounded by non-terry fabric. In other embodiments, the garment includes four discrete (separate from each other) terry-cloth regions, each one of them surrounded by non-terry fabric. In other embodiments, the garment includes five or more discrete (separate from each other) terry-cloth regions, each one of them surrounded by non-terry fabric.

In some embodiments, the garment includes a single non-terry cloth region, that is surrounded by terry-knitted fabric. In other embodiments, the garment includes two discrete (separate from each other) non-terry regions, each one of them surrounded by terry-knitted fabric. In other embodiments, the garment includes three discrete (separate from each other) non-terry regions, each one of them surrounded by terry-knitted fabric. In other embodiments, the garment includes four discrete (separate from each other) non-terry regions, each one of them surrounded by terry-knitted fabric. In other embodiments, the garment includes five discrete (separate from each other) non-terry regions, each one of them surrounded by terry-knitted fabric.

In some embodiments, the one or more terry regions of the garment are mesh knitted via Mesh knitting technique, while one or two or three or more yarns are floating in or towards or through different needles and/or sinkers selections (e.g., some but not all the available needles and/or sinkers, as controlled by a knitting machine; or by using one or more sinkers or sinker elements on which the knitted yarn is mounted; or by using other combination of needles selection and/or sinker selection and/or terry selection), such as 1×1, 2×1, 3×1, or the like, while a ground yarn (or several ground yarns) are knitted by all the available needles. Similarly, in some embodiments, the one or more terry regions of the garment are knitted by Rib or Pique knitting, while all the yarns are floating in or through different needles selections. Similarly, in some embodiments, the one or more terry regions of the garment are knitted via terry knitting, while one or two or three or more yarns are knitted with larger loops relative to the ground yarn (or the several ground yarns), thereby creating Terry knitting contraction. In some embodiments, the knitting of such Terry region may be performed via a single Jersey knitting; or may be integrated or combined with other knitting techniques such as different Rib, different Pique, different Mesh, different holes sizes, different loop sizes. Similarly, some embodiments may integrate or combine the knitting of the rest of the garment, beside the Terry knitting, with another suitable knitting method, such as Mesh or Rib or Pique knitting. It is noted that for demonstrative purposes, some portions of the discussion herein relate to either a Terry region, or a Non Terry region; however, some embodiments may similarly include one or more Hybrid regions or Combined regions, in which specific selection of needles and/or sinkers would result in semi-Terry semi-Non-Terry region, or other ratio among them; for example, having 8 feeders, some of which provide Terry knitting via the sinkers, whereas the remaining feeders provide Non Terry knitting via the needles, to thereby create a mixed or combined or hybrid region.

Some embodiments may knit the Terry zone(s) or the Terry region(s), or the rest (non-terry) zones or regions of the same garment, with any type or combination of fibers or yarns or blends; such as: Nylon, Polyester, Cotton, Modal, Tencel, Spandex, Lycra, Wool, Silk, Spandex, and/or while also covered or combined with one or more other yarns or fibers, melting yarns, any kind of other yarns blend, or the like, in any suitable count or yarn-count or thread-count.

In some embodiments, one or more of the yarns or threads being used, for the terry region(s) and/or for the non-terry region(s) of the garment, may optionally have one or more functional properties, or may comprise or may be coated with a particular agent or functional agent; for example, anti-odor agent or yarn, anti-scar agent or yarn, anti-bacterial agent or yarn, cooling agent or yarn, warming agent or yarn, thermo-regulation or thermal-regulation agent or yarn, decorative agent or yarn, coloring agent or yarn, sweat/moisture/wetness absorbing or transporting agent or yarn, water repellent agent or yarn, padding agent or yarn, yarns which comprise or are coated with particular vitamins and/or minerals, yarn which comprises or is coated with cosmetic agents or cosmetic treatments, yarn which comprise or is coated with semi medical agents or treatments (e.g., anti-fungus or anti-fungal agents), or the like.

The unified garment which combines terry region(s) and adjacent or surrounding non-terry regions, may be further processed or knitted or treated with other functionalities; for example, pockets may be added, stitches, melting process of melting yarn(s), printing, bonding/gluing/sewing of add-ons or accessories or garment components (e.g., zipper, buckle, hook-and-eye, buttons, pockets), coloring, pre-knitting coloring of yarn(s), post-knitting coloring of yarn(s), ultrasonic bonding, ultrasonic gluing, heat press of yarns, pre-boarding, steaming, washing, dyeing (applying of a dye or coloring agent), applying or adding softeners or additives, heat press, or the like.

Figure 1B:
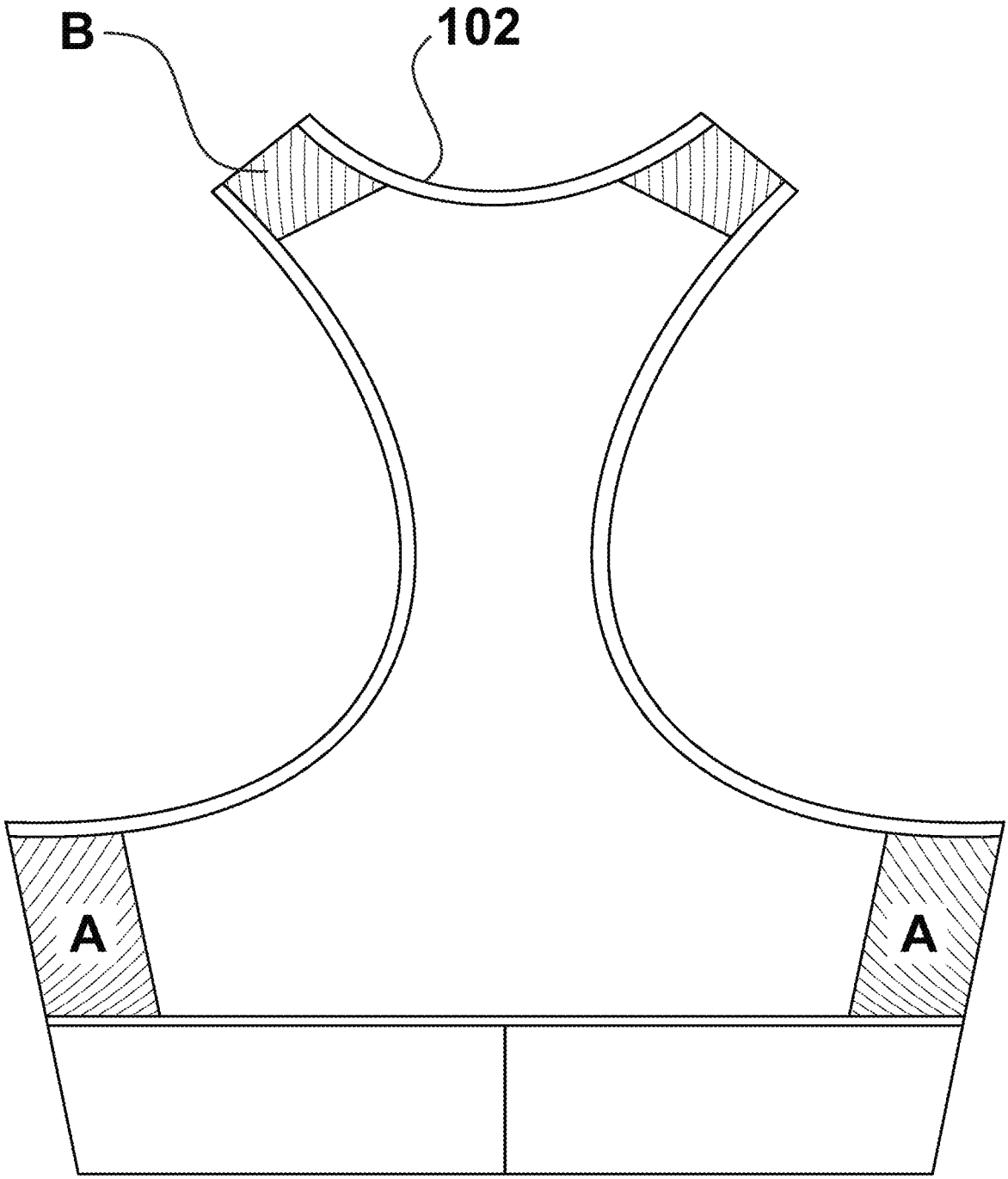

Reference is made to FIGS. 1A and 1B, which are schematic illustrations of a front-view (101) and a back-view (102) of a bra or sports bra, or other garment which covers or partially covers or supports the breasts of a female wearer, in accordance with some demonstrative embodiments of the present invention. For example, region A is a terry cloth or is terry knitted, to serve one or more functional purposes such as: to provide further support to the breasts, to provide additional warmth to the breasts or to the chest area, to better cover or hide the nipples and provide modesty to the wearer, or to provide a push-up effect to the breasts or as an alternative of pulled-out cups, or the like. Additionally or alternatively, region B is terry cloth or is terry knitted, to serve one or more functional purposes such as: to provide shoulder padding to (or near) the shoulders, or to enhance the convenience of the wearer at or near the shoulders area, or the like. The remainder of this garment, or the other regions or portions of this garment, are formed of non-terry cloth or non-terry knitted fabric. The transition from a terry region to an adjacent non-terry region of this garment is a smooth, seam-less and continuous transition; and the two adjacent regions are non-overlapping to each other and are spatially located on the same plane and are not one on top of the other.

Figure 2A:
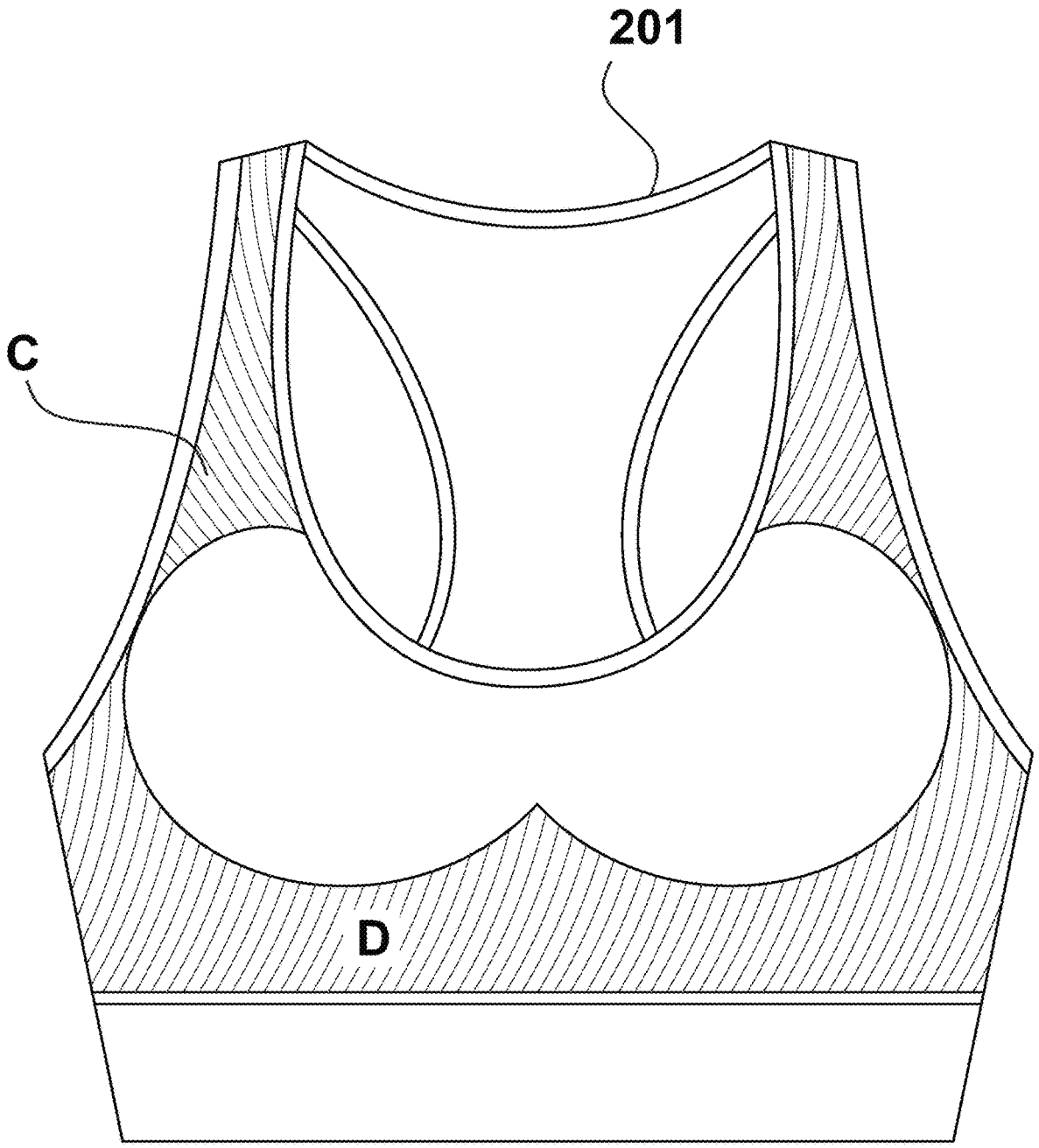
FIGS. 2A and 2B are schematic illustrations of front-view and back-view of a bra or sports bra, or other garment which covers or partially covers or supports the breasts of a female wearer, in accordance with some demonstrative embodiments of the present invention.
Figure 2B:
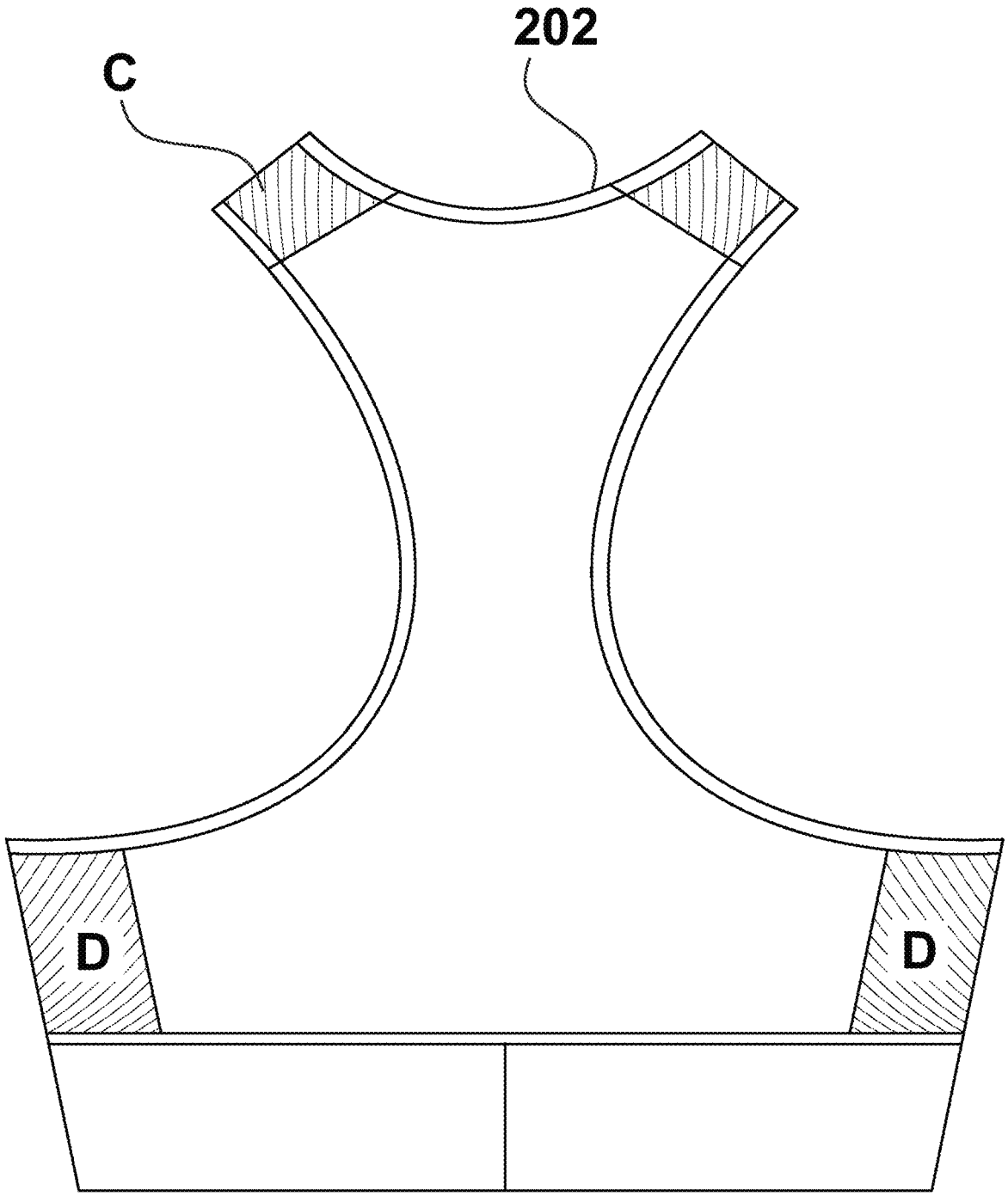

Reference is made to FIGS. 2A and 2B, which are schematic illustrations of a front-view (201) and a back-view (202) of a bra or sports bra, or other garment which covers or partially covers or supports the breasts of a female wearer, in accordance with some demonstrative embodiments of the present invention. For example, region D is a terry cloth or is terry knitted, to serve one or more functional purposes such as: to provide further support to the breasts, to provide bust support or increased bust support, to provide additional warmth to the breasts or to the chest area, to provide sweat absorption near or at or under the breasts, to provide support instead of an under-bust wire or in addition to an under-bust wire, to provide a push-up effect to the breasts, or the like. Additionally or alternatively, region C is terry cloth or is terry knitted, to serve one or more functional purposes such as: to provide padding or warmth or convenience at or near the shoulders area, or to provide a reduced-elasticity shoulders area which stretches less relative to non-terry cloth, or the like. The remainder of this garment, or the other regions or portions of this garment, are formed of non-terry cloth or non-terry knitted fabric. The transition from a terry region to an adjacent non-terry region of this garment is a smooth, seam-less and continuous transition; and the two adjacent regions are non-overlapping to each other and are spatially located on the same plane and are not one on top of the other. Other that the elbow-regions E and the stomach-region G, the remainder of this garment may be formed of non-terry cloth or non-terry knitted fabric.

Figure 3A:
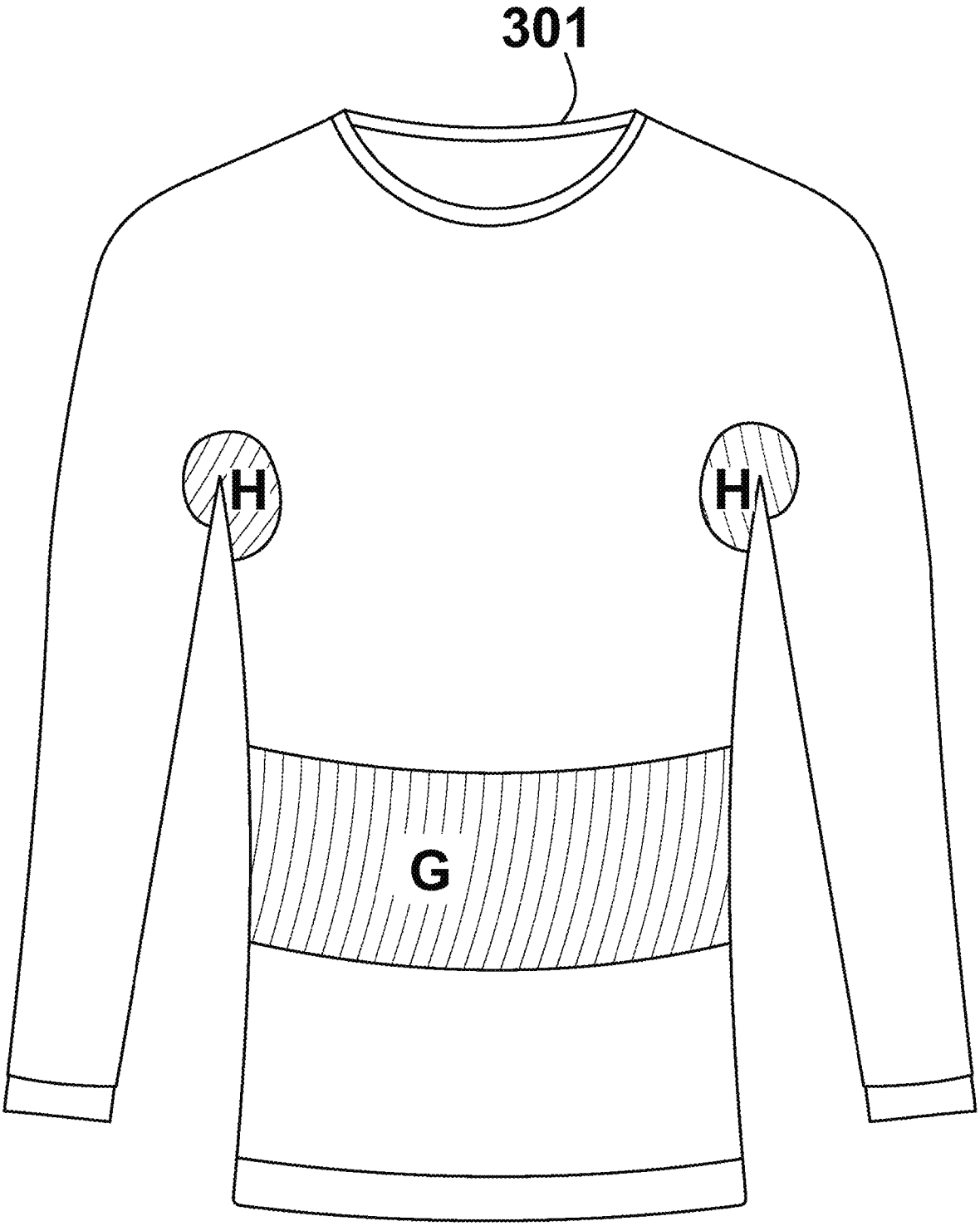
FIGS. 3A and 3B are schematic illustrations of front-view and back-view of a shirt, or other garment which covers or partially covers the chest and back of a human wearer, in accordance with some demonstrative embodiments of the present invention.
Figure 3B:
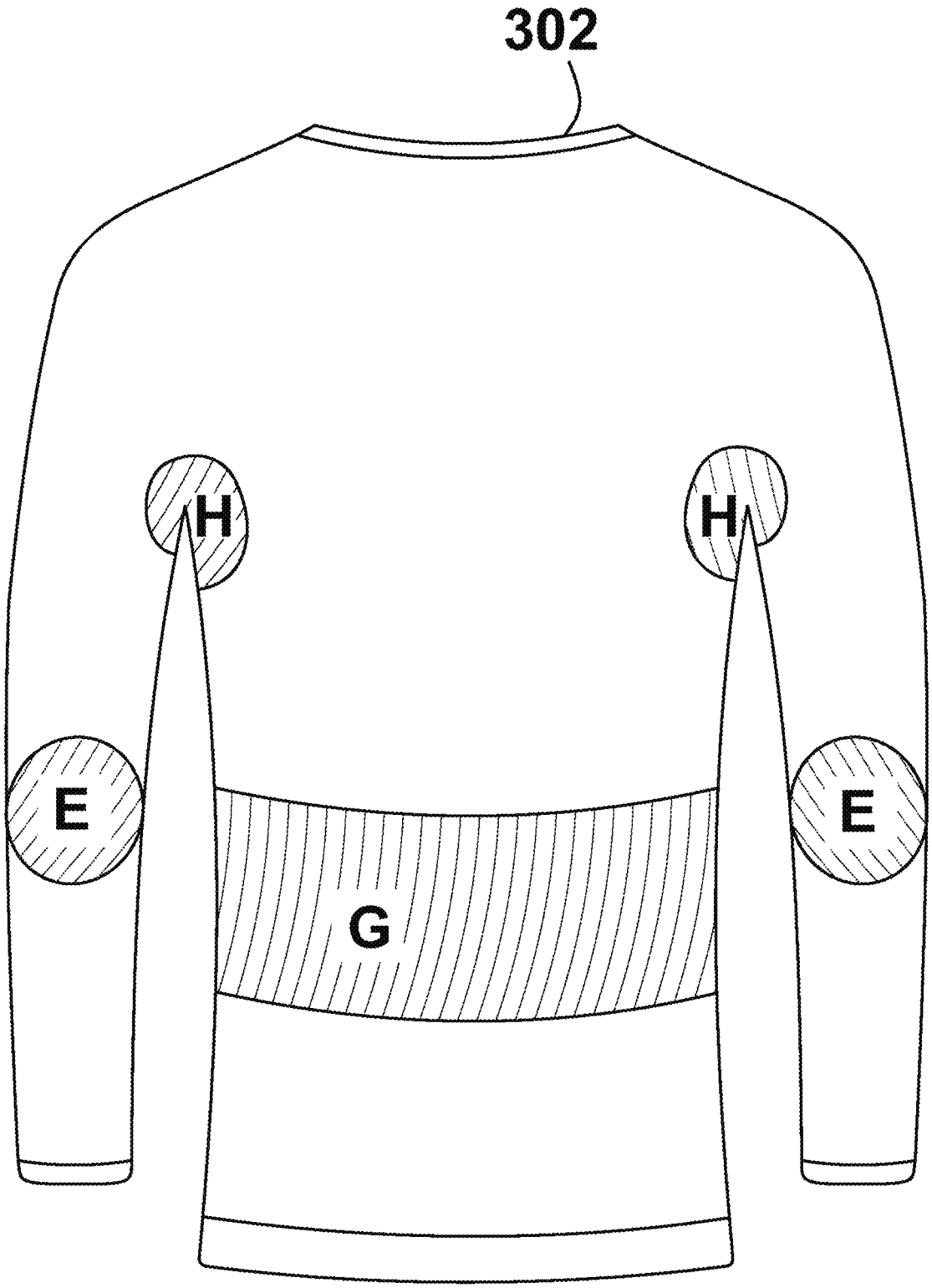

Reference is made to FIGS. 3A and 3B, which are schematic illustrations of a front-view (301) and a back-view (302) of a shirt, or other garment which covers or partially covers the chest and back of a human wearer, in accordance with some demonstrative embodiments of the present invention. For example, right-side region E and left-side region E are terry cloth or terry knitted, to serve one or more functional purposes such as: to provide further protection or warmth or padding to the elbow. It is clarified that region E is not a "patch" and is not a "cover" that is sewn or boned on glued on top of a fabric layer or on top of another layer of non-terry cloth; but rather, the garment continuous and transitions smoothly and seamlessly from the elbow-region E which is terry knitted, to the surrounding or adjacent non-terry fabric, which are all on at the same layer or plane, and are not overlapping one on top of the other.

Additionally or alternatively, region G is terry cloth or is terry knitted, to serve one or more functional purposes such as: to provide padding or warmth or convenience at or near particular body organs or body areas (e.g., kidneys, stomach). It is clarified that region G, which is generally ring shaped or donut shaped or bagel shaped, is not a "patch" and is not a "cover" that is sewn or boned on glued on top of a fabric layer or on top of another layer of non-terry cloth; but rather, the garment continuous and transitions smoothly and seamlessly from the ring-shaped G which is terry knitted, to the surrounding or adjacent non-terry fabric, which are all on at the same layer or plane, and are not overlapping one on top of the other.

Additionally or alternatively, region H is located at or near or under the armpit, and is formed of terry cloth or is terry knitted, to serve one or more functional purposes such as: to absorb sweat or wetness from the armpit or from the armpit area; to prevent appearance of wet spots or sweat spots under or near the armpits. It is clarified that region H is not a "patch" and is not a "cover" that is sewn or boned on glued on top of a fabric layer or on top of another layer of non-terry cloth; but rather, the garment continuous and transitions smoothly and seamlessly from region H which is terry knitted, to the surrounding or adjacent non-terry fabric, which are all on at the same layer or plane, and are not overlapping one on top of the other.

Figure 4A:
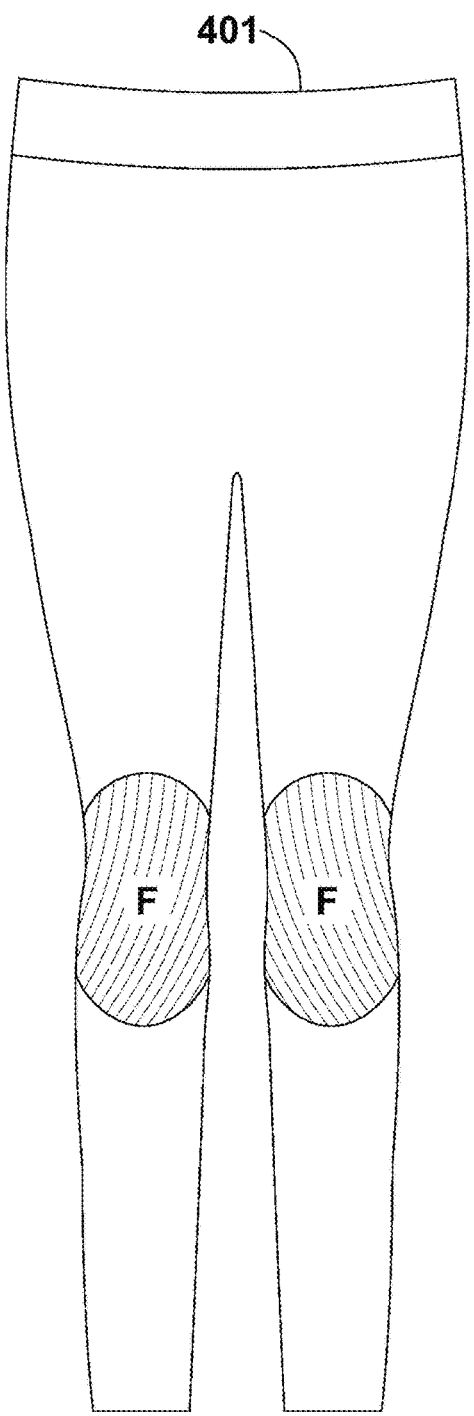
FIGS. 4A and 4B are schematic illustrations of front-view and back-view of a pair of pants (or trousers, or leggings, or tights, or activewear), or other garment which covers or partially covers the legs and/or hips of a human wearer, in accordance with some demonstrative embodiments of the present invention.
Figure 4B:
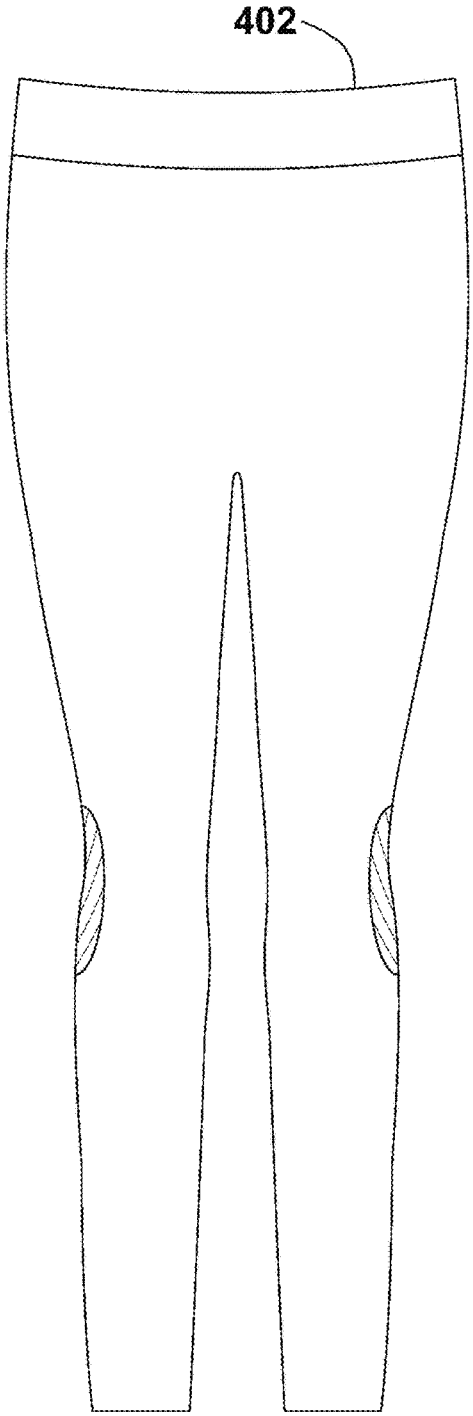

Reference is made to FIGS. 4A and 4B, which are schematic illustrations of a front-view (401) and a back-view (402) of a pair of pants (or trousers, or leggings, or tights, or activewear), or other garment which covers or partially covers the legs and/or hips of a human wearer, in accordance with some demonstrative embodiments of the present invention. For example, right-side knee region F and left-side knee region F are terry cloth or terry knitted, to serve one or more functional purposes such as: to provide further protection or warmth or padding to the knee. It is clarified that region F is not a "patch" and is not a "cover" that is sewn or boned on glued on top of a fabric layer or on top of another layer of non-terry cloth; but rather, the garment continues and transitions smoothly and seamlessly from the knee-region F which is terry knitted, to the surrounding or adjacent non-terry fabric, which are all on at the same layer or plane, and are not overlapping one on top of the other. Other that the knee-regions F, the remainder of this garment may be formed of non-terry cloth or non-terry knitted fabric.

Figure 7A:
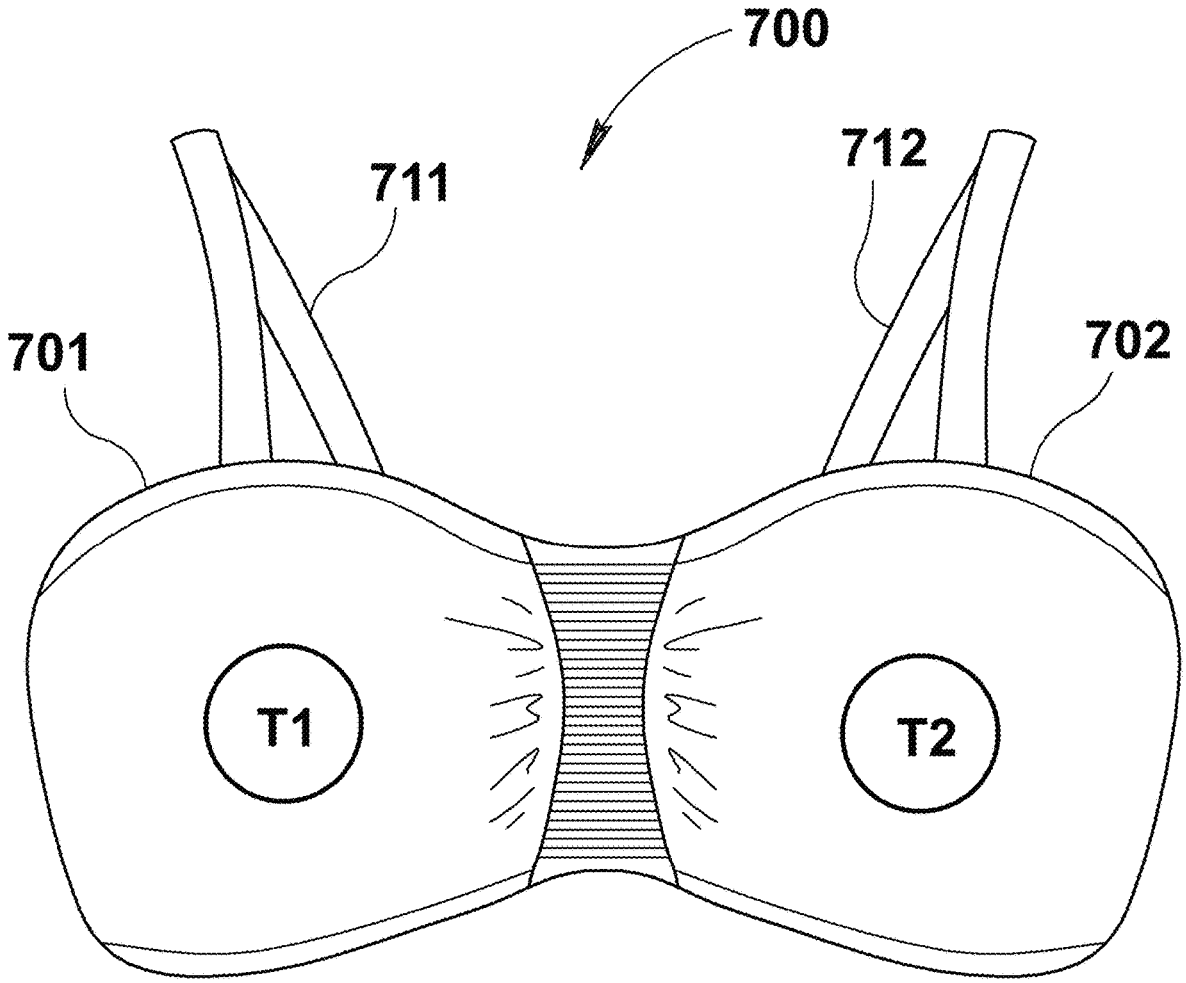
FIG. 7A is a schematic illustration of a front-view of a bra, in accordance with some demonstrative embodiments of the present invention.
Figure 7B:
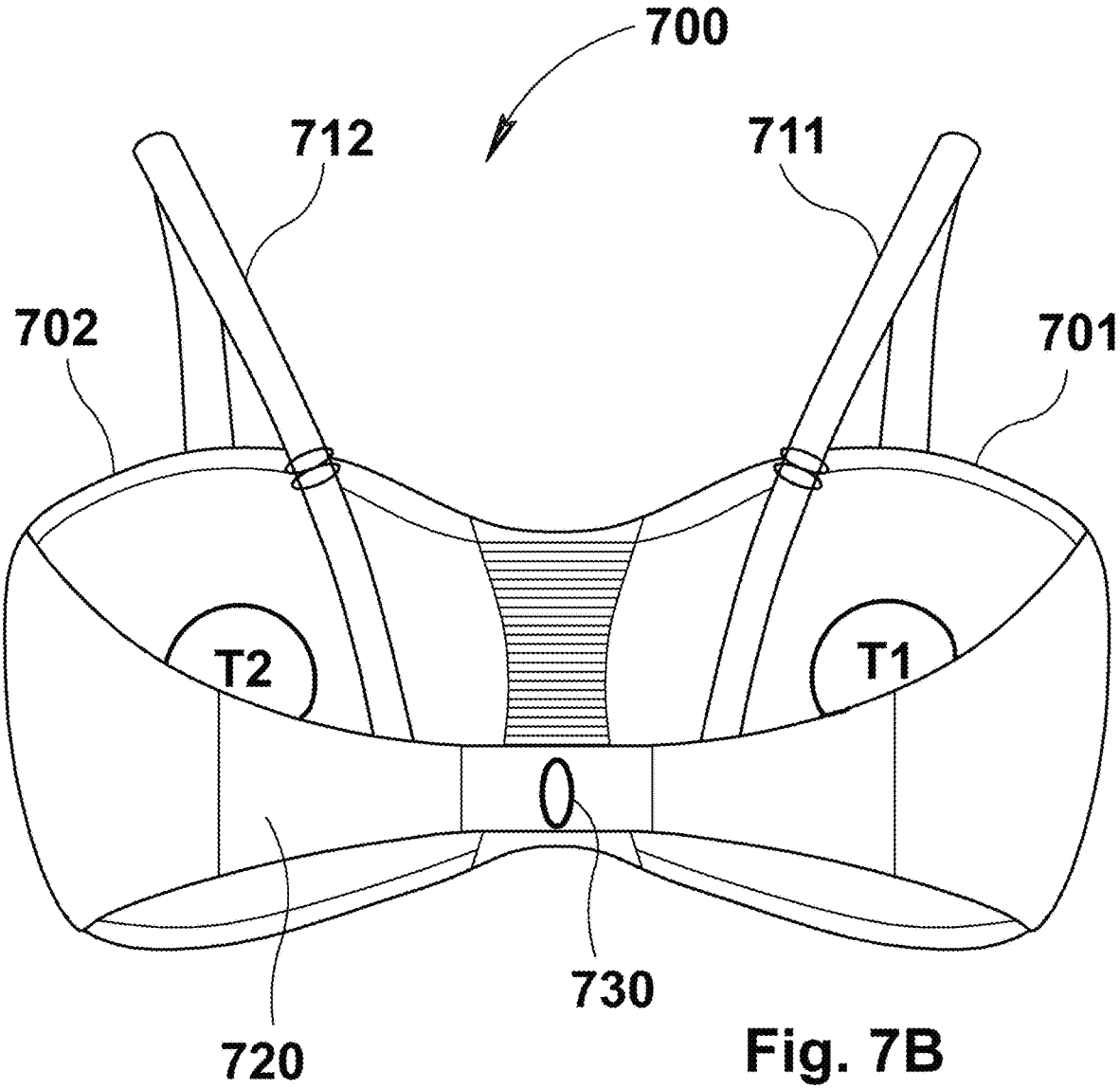
FIG. 7B is a schematic illustration of a rear-view of the bra, in accordance with some demonstrative embodiments of the present invention.

Reference is made to FIG. 7A, which is a schematic illustration of a front-view of a bra 700, in accordance with some demonstrative embodiments of the present invention; and to FIG. 7B, which is a schematic illustration of a rear-view of the bra 700, in accordance with some demonstrative embodiments of the present invention. Bra 700 may be a brassiere for any female wearer, or may be a particular type of bra such as a maternity bra or a pregnancy bra or a breast-feeding bra, or a sports bra. Bra 700 includes two cups 701-702 which hold or support or hide or partially-hide the breasts of a female wearer; and optionally include two shoulder straps 711-712; and further include a back-strap 720. A closing and opening mechanism 730 (e.g., hook-and-eye mechanism, Velcro mechanism, or the like) is shown in the rear side of the bra or at the back-strap 720; although in some embodiments, such closing and opening mechanism may be located in the front side of the bra (e.g., between the two cups 701-702). In accordance with the present invention, bra 700 is formed generally of non-terry cloth or non-terry knitting; whereas particular portions or regions or zones of bra 700 are formed of terry cloth or terry knitting. For example, a nipple region or a nipple-surrounding region (denoted T1 in cup 701; denoted T2 in cup 702) is formed of terry cloth or terry knitting; whereas the remainder of each cup (701, 702) that surrounds the nipple region (T1, T2) is formed of non-terry cloth or non-terry knitting. For demonstrative purposes, the terry cloth nipple regions (T1, T2) are shown as circles; however, they may have other suitable shape, e.g., a square, a rectangle, a triangle, a polygon, an oval, a flower shape, a star shape, or the like. The terry knitting or terry cloth in those regions (T1, T2) may serve one or more functional purposes, such as: to provide modesty by hiding or further hiding the nipple; to provide privacy for a lactating mother whose nipples may be wet from lactation; to absorb lactation or breast milk residue or breast milk output from the nipple(s) and to prevent visible wet spots on the bra and/or on a shirt; or the like. The terry region (T1, T2) is on the same plane and level as the remainder of the respective cup (701, 702), such that each cup includes a continuous and smooth and seamless transition from the terry region (T1, T2) to the surrounding non-terry knitting around it. For demonstrative purposes, bra 701 is shown with two shoulder straps 711-712; however, in other embodiments, such bra may have a single shoulder-strap, or may be a strapless bra that lacks any shoulder straps. The present invention may further comprise other chest-covering or chest-supporting garments; for example, a maternity bra, a lactation bra, a breast-feeding bra, a pregnancy bra, a swimsuit, a lingerie item, a camisole, a corset, or the like, which have an integrated terry cloth in one or more particular region(s) thereof, seamlessly surrounded by and adjacent to non-terry knitting.

Figure 8A:
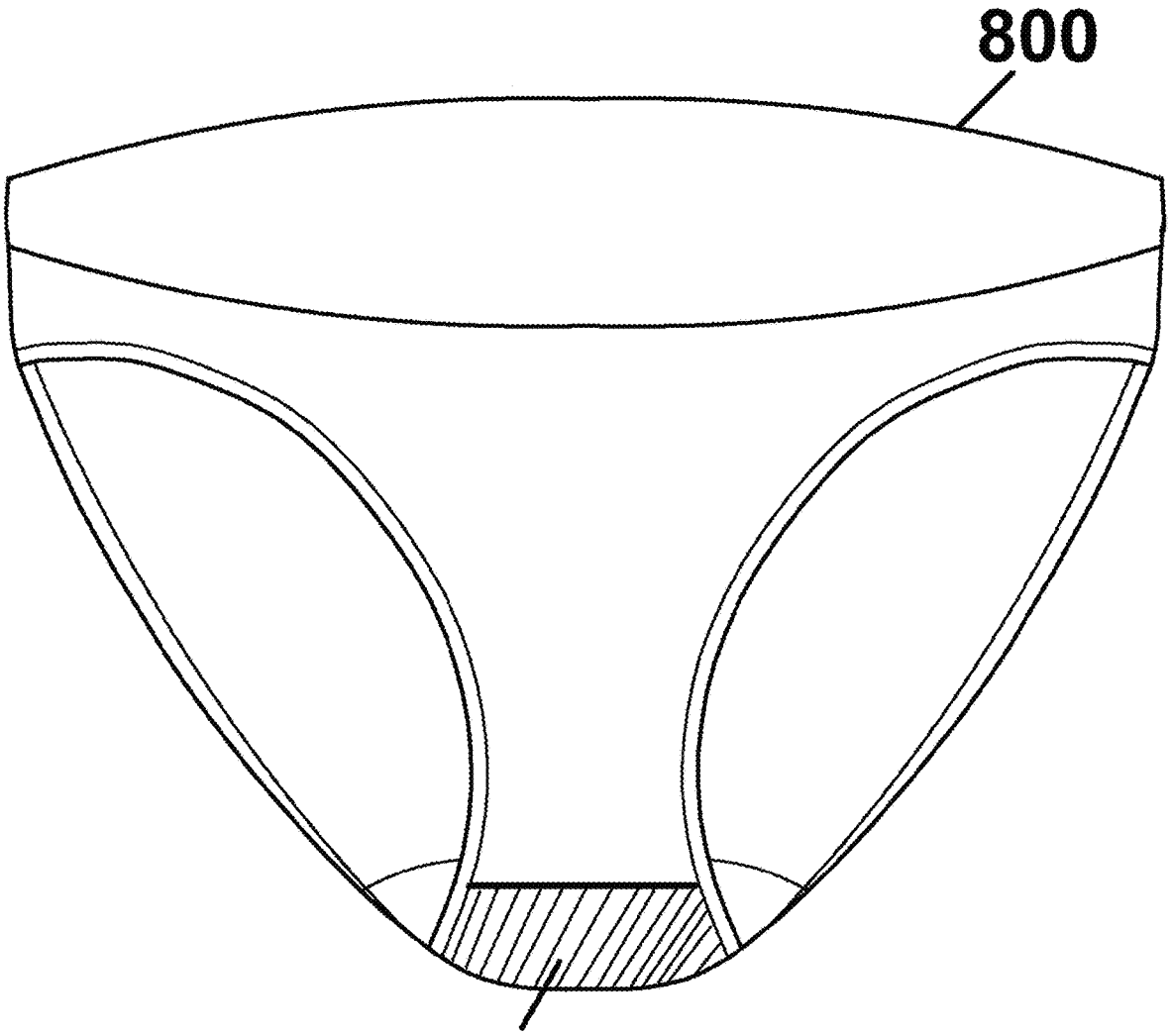
FIG. 8A is a schematic illustration of a front-view of an underwear, in accordance with some demonstrative embodiments of the present invention.
Figure 8B:
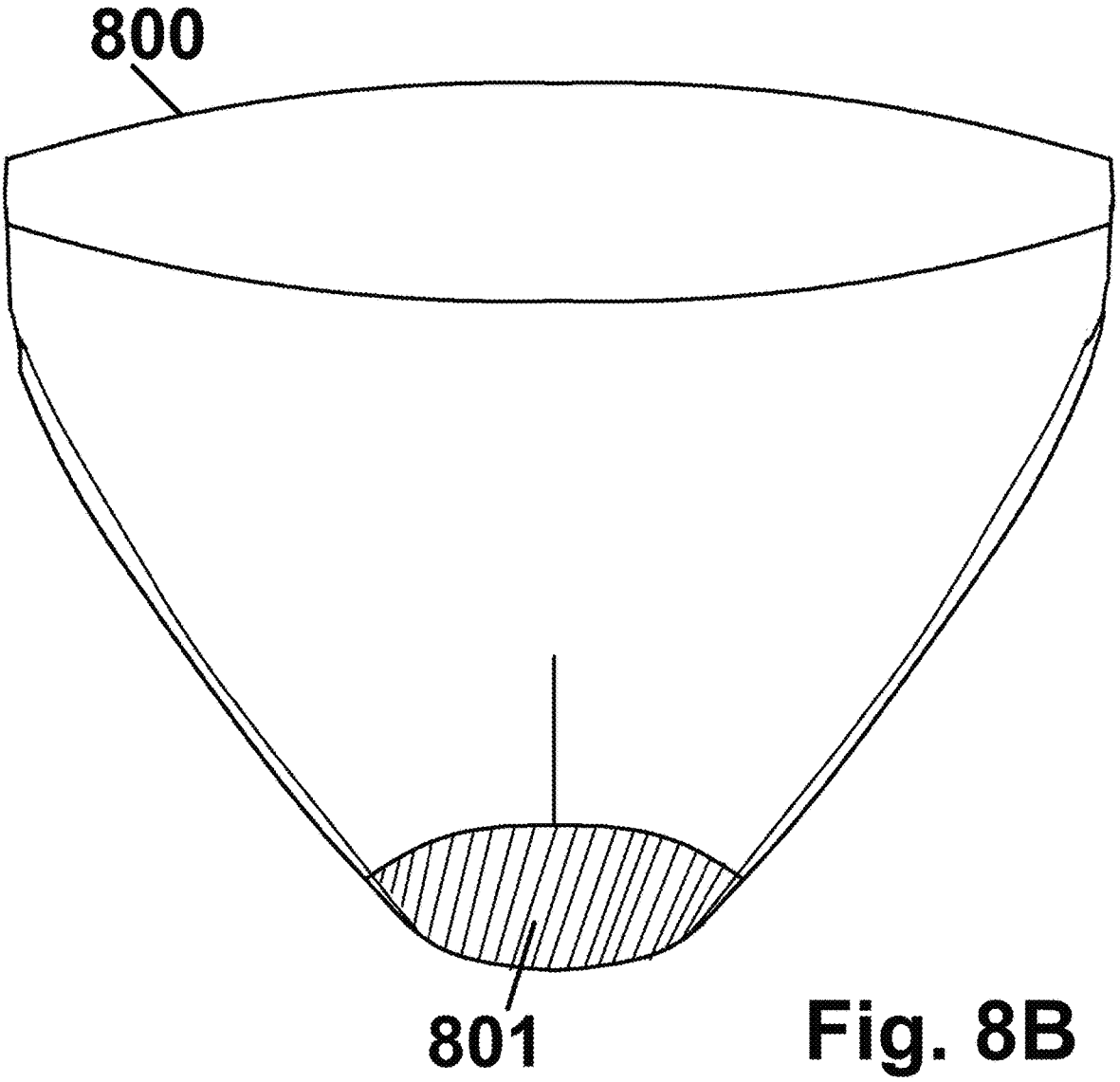
FIG. 8B is a schematic illustration of a rear-view of the underwear, in accordance with some demonstrative embodiments of the present invention.

Reference is made to FIG. 8A, which is a schematic illustration of a front-view of an underwear 800, in accordance with some demonstrative embodiments of the present invention; and to FIG. 8B, which is a schematic illustration of a rear-view of the underwear 800, in accordance with some demonstrative embodiments of the present invention. In accordance with the present invention, underwear 800 is formed generally of non-terry cloth or non-terry knitting; whereas particular portions or regions or zones of underwear 800 are formed of terry cloth or terry knitting. For example, a gusset region 801 or a bottom region, shown with diagonal lines, is formed of terry cloth or terry knitting; whereas the remainder of the underwear 800 is formed of non-terry cloth or non-terry knitting. The terry knitting or terry cloth in region 801 may serve one or more functional purposes, such as: to absorb wetness or urine or urine residue or menstrual cycle blood or excretions; to prevent visible wet spots on underwear and/or on a pair of pants that is worn; or the like. The terry region 801 is on the same plane and level as the remainder of the underwear 800, such that the underwear 800 features a continuous and smooth and seamless transition from the terry region 801 to the surrounding non-terry knitting around it. Underwear 800 may be, in some embodiments, a female underwear, a male underwear, a child underwear, a senior citizen underwear, or the like. The present invention may further comprise other garments or undergarments which cover (partially or entirely) the genitalia of a wearer, and have an integrated terry cloth in one or more particular region(s) thereof, seamlessly surrounded by and adjacent to non-terry knitting.

Some embodiments may include a garment having a unique combination of (i) one or more terry knitted regions, that are adjacent to or surrounded by or that are seamlessly touching or seamlessly bordering with (ii) one or more non-terry knitted regions.

Additionally or alternatively, in some embodiments, the terry region(s) have increased thickness than the non-terry region(s) of the same garment. In other embodiments, the terry region(s) have reduced thickness than the non-terry region(s) of the same garment. In still other embodiments, the terry region(s) have the same thickness as the non-terry region(s) of the same garment.

Additionally or alternatively, in some embodiments, the terry region(s) have increased rigidity or rigidness than the non-terry region(s) of the same garment. In other embodiments, the terry region(s) have reduced rigidity or rigidness than the non-terry region(s) of the same garment. In still other embodiments, the terry region(s) have the same rigidity or rigidness as the non-terry region(s) of the same garment.

Additionally or alternatively, in some embodiments, the terry region(s) have increased elasticity or flexibility than the non-terry region(s) of the same garment. In other embodiments, the terry region(s) have reduced elasticity or flexibility than the non-terry region(s) of the same garment. In still other embodiments, the terry region(s) have the same elasticity or flexibility as the non-terry region(s) of the same garment.

Additionally or alternatively, in some embodiments, the terry region(s) provide an increased level of warmth than the non-terry region(s) of the same garment. In other embodiments, the terry region(s) provide a reduced level of warmth than the non-terry region(s) of the same garment. In still other embodiments, the terry region(s) provide the same level of warmth as the non-terry region(s) of the same garment.

Additionally or alternatively, in some embodiments, the terry region(s) provide an increased level of support (e.g., bust support, breast support) than the non-terry region(s) of the same garment. In other embodiments, the terry region(s) provide a reduced level of support than the non-terry region (s) of the same garment. In still other embodiments, the terry region(s) provide the same level of support as the non-terry region(s) of the same garment.

Additionally or alternatively, in some embodiments, the terry region(s) provide an increased level of sweat absorption or moisture absorption than the non-terry region(s) of the same garment. In other embodiments, the terry region(s) provide a reduced level of sweat absorption or moisture absorption than the non-terry region(s) of the same garment. In still other embodiments, the terry region(s) provide the same level of sweat absorption or moisture absorption as the non-terry region(s) of the same garment.

Additionally or alternatively, in some embodiments, the terry region(s) provide an increased level of sweat transport or moisture transport than the non-terry region(s) of the same garment. In other embodiments, the terry region(s) provide a reduced level of sweat transport or moisture transport than the non-terry region(s) of the same garment. In still other embodiments, the terry region(s) provide the same level of sweat transport or moisture transport as the non-terry region(s) of the same garment.

Additionally or alternatively, in some embodiments, the terry region(s) is formed of a first type of yarn having a first thread-count; whereas the non-terry region(s) is formed of a second yarn type and/or having a second thread-count. In other embodiments, the terry region(s) and the non-terry region(s) of the same garment may be formed of the same yarn type and/or of the same thread-count, or may be formed of different yarn types and/or different thread-counts.

The present invention further includes a method or process of producing or making or manufacturing a garment which has both (i) one or more terry-knit regions and (ii) one or more adjacent or surrounding non-terry knit regions. The method may comprise, for example: (a) operating or utilizing a knitting machine to knit a first garment-region at a non-terry knitting techniques; (b) switching the knitting machine to knit at a terry knitting technique, and continuing to knit the same garment by terry knitting a second garment-region with a seamless and continuous transition from the first garment-region; (c) optionally, switching back the knitting machine to non-terry knitting, and repeating step (a), or repeating steps (a) and (b), one time or multiple additional times. The switching of the knitting machine or of the knitting process, from terry knitting to non-terry knitting, or vice versa, may be performed manually by a human operator; or may be performed automatically or semi-automatically by the knitting machine itself and/or by a controller unit or a control unit or other knitting controller or knitting regulator that commands the knitting machine to modify its operational properties, optionally in accordance with a predefined knitting plan that reflects the properties of different regions of the desired garment.

In some embodiments, the method may be used to produce a cylindrical roll of fabric, or an elongated sheet of fabric which may be rolled or folded or otherwise stored, and which may feature a combination of (i) terry knitted regions, that are adjacent to or seamlessly bordering with (ii) non-terry knitted regions. Optionally, the different types of regions (terry and non-terry) may be structured in accordance with a pre-defined pattern or decoration or logo, or in accordance with a repeating pattern; for example, checkered pattern or a pattern similar to chess-board, zebra lines pattern, alternating lines or rows, alternating squares or polygons, or the like; circular or elliptical or curved areas that are terry knit and are spread across the fabric sheet; or the like. Such sheet or roll of fabric may later be cut, by a human or by a machine, to form a suitable fabric article or textile article; for example, a carpet, a rug, a blanket, a curtain, a map, a table map, a table cloth, or the like.

Figure 5:
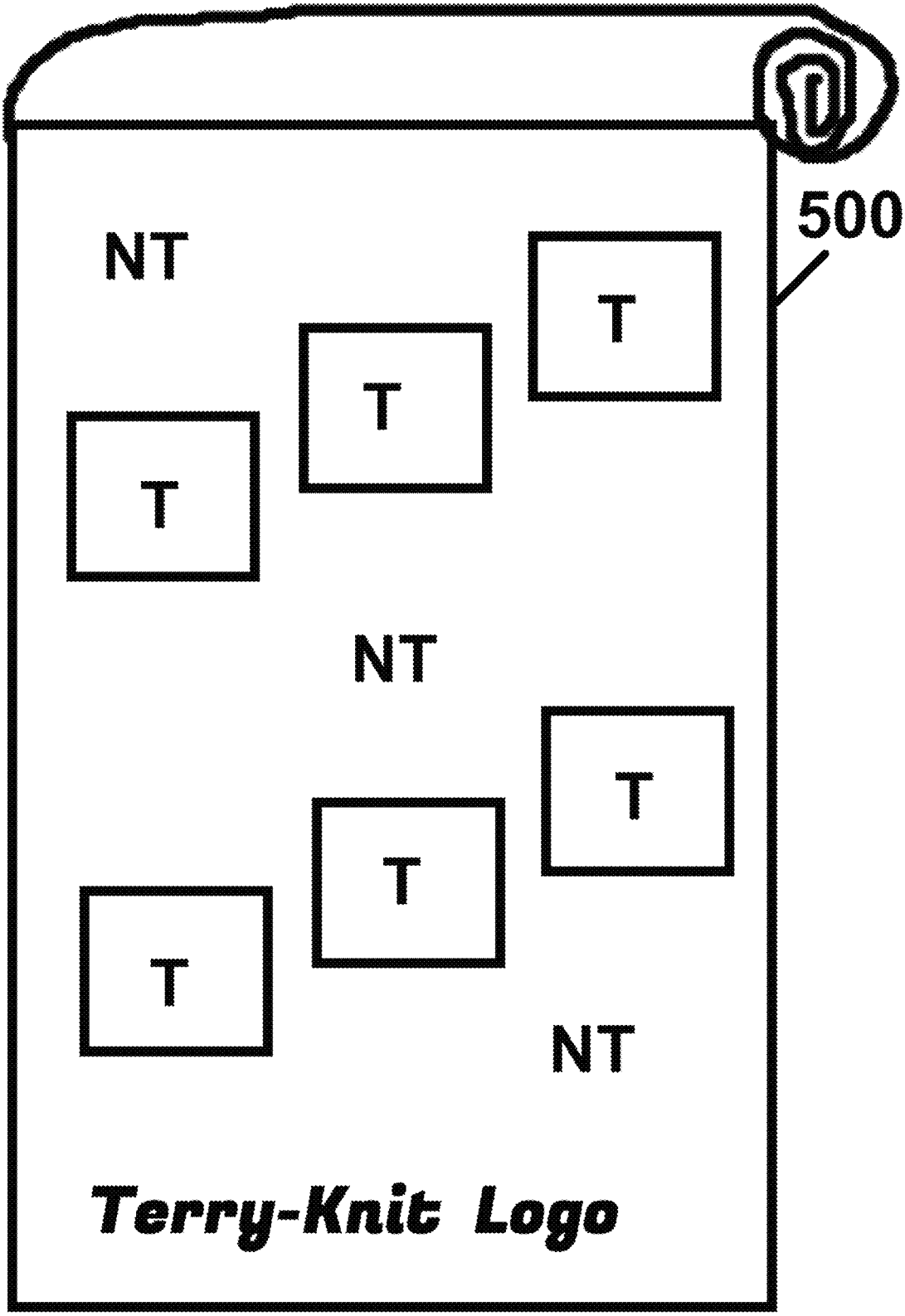
FIG. 5 is a schematic illustration of a roll of continuous fabric, in accordance with some demonstrative embodiments of the present invention.

Reference is made to FIG. 5, which is a schematic illustration of a roll of continuous fabric 500, in accordance with some demonstrative embodiments of the present invention. Terry-knit fabric-regions are marked with "T", and they are surrounded by non-terry-knit fabric-regions that are marked with "NT". Optionally, a terry-knit logo may also be incorporated into such fabric.

Figure 6:
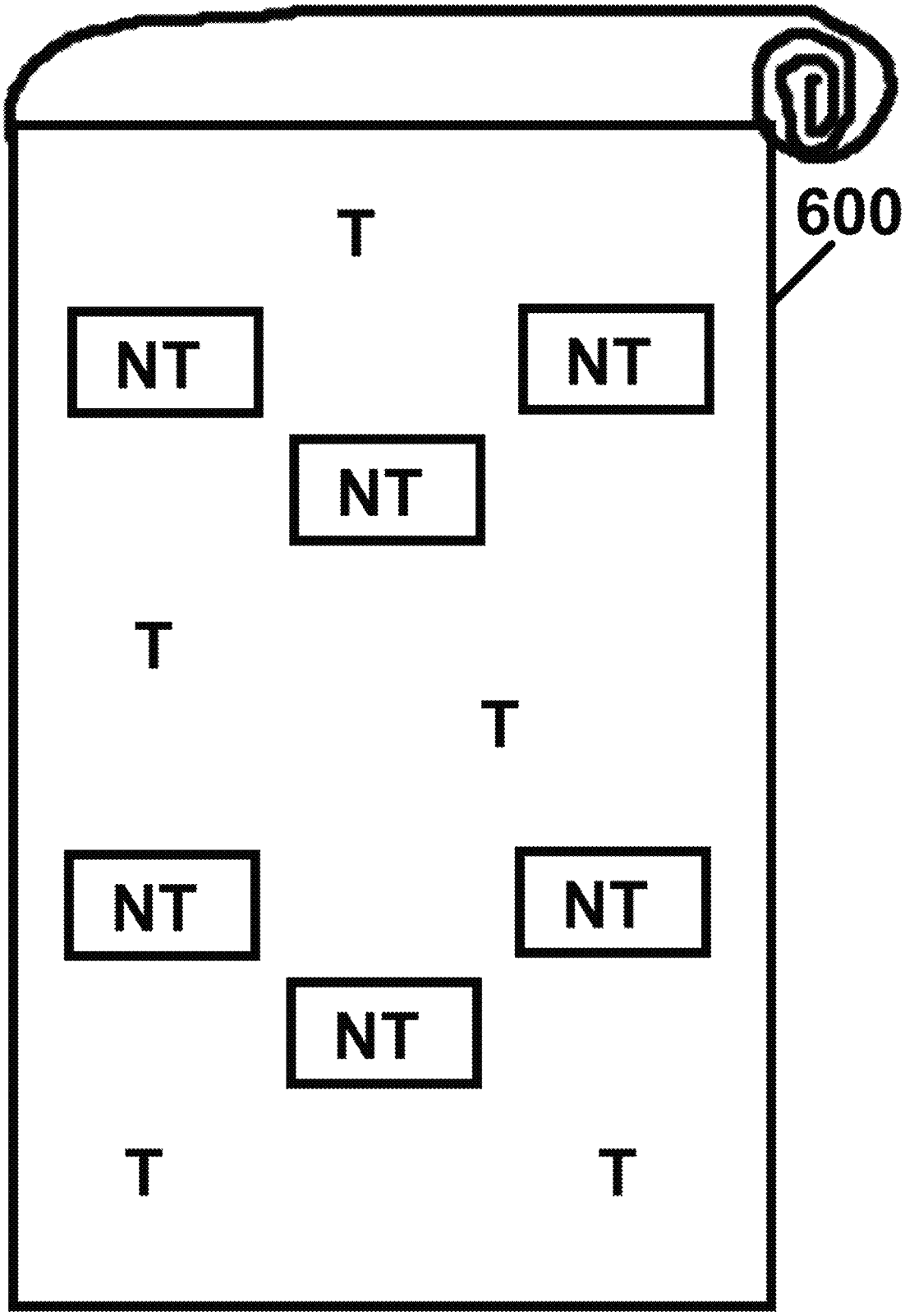
FIG. 6 is a schematic illustration of another roll of continuous fabric, in accordance with some demonstrative embodiments of the present invention.

Reference is made to FIG. 6, which is a schematic illustration of a roll of continuous fabric 600, in accordance with some demonstrative embodiments of the present invention. Non-terry-knit fabric-regions are marked with "NT", and they are surrounded by terry-knit fabric-regions that are marked with "T".

In some embodiments, the term "fabric" or the term "knitted" indicates a material made of yarn that is woven or knitted, or a piece of woven-or-knitted yarn, or a piece of woven yarn, or a piece of knitted yarn; and is not, for example, a patch or piece of leather; and is not, for example, a patch or piece of foam or plastic or sponge; and is not, for example, a patch or piece of other non-woven non-knitted material.

The discussion herein may relate, for demonstrative purposes, to a bra or to a shirt or to pants. However, the present invention may similarly comprise, or may similarly be used in conjunction with, other suitable garments and/or undergarments and/or clothing articles; for example, panties, boxers, briefs, underwear, shorts, sportswear, active-wear, yoga pants, aerobic pants, training pants, lingerie, thongs, shaper, body-shaper, shaping garment, shaping undergarment, shape-wear, active-wear, sports-wear, form-fitting undergarment, form-fitting garment, swimsuit, swim-wear, pants, trousers, socks, shirt, sweat-shirt, jacket, coat, apron, long-sleeve shirt, short-sleeve shirt, Polo shirt, T-shirt, skirt, dress, sports-skirt, tennis skirt, or the like.

Some embodiments of the present invention may be implemented by using a machine or an automated or semi-automatic production line, which may comprise, for example: cutting unit, welding unit, bonding unit, ultrasonic operations unit, gluing unit, conveyor belt, robotic arm, control unit, workstation; as well as suitable hardware components and/or software components, for example, processor to execute code, memory unit, storage unit, input unit (keyboard, mouse, touch-screen), output unit (screen, touch-screen), modems, transceivers or transmitters or receivers, wireless and/or wired communication links and/or transceivers or transmitters or receivers, power sources, Operating System (OS) and suitable applications, or the like.

Some embodiments include a garment for a human wearer, the garment comprising: a terry garment-region having terry-knit cloth, and a non-terry garment-region having non-terry-knit cloth; wherein the terry garment-region is directly bordering and adjacent to the non-terry garment-region; wherein the terry garment-region and the non-terry garment-region are a seamless continuation of each other.

In some embodiments, the terry garment-region and the non-terry garment-region are located on a same plane and have a same thickness. In some embodiments, the terry garment-region is a continuous knitted fabric that continues the adjacent non-terry garment-region. In some embodiments, the terry garment-region is a non-patched non-stitched portion of said garment. In some embodiments, the terry garment-region is surrounded, from all its sides, by the non-terry garment-region. In some embodiments, the terry garment-region is a direct knitted continuation of the non-terry garment region. In some embodiments, the terry garment-region and the non-terry garment region are a single layer of fabric; wherein the terry garment-region is neither over nor under the non-terry garment region.

In some embodiments, the terry garment-region and the non-terry garment region have the same thickness. In some embodiments, the terry garment-region has a first thickness; wherein the non-terry garment region has a second thickness that is smaller than the first thickness. In some embodiments, the terry garment-region has a first thickness; wherein the non-terry garment region has a second thickness that is greater than the first thickness. In some embodiments, the terry garment-region and the non-terry garment region have the same level of rigidity. In some embodiments, the terry garment-region has a first level of rigidity; wherein the non-terry garment region has a second level of rigidity that is smaller than the first level of rigidity. In some embodiments, the terry garment-region has a first level of rigidity; wherein the non-terry garment region has a second level of rigidity that is greater than the first level of rigidity. In some embodiments, the terry garment-region and the non-terry garment region have the same level of elasticity. In some embodiments, the terry garment-region has a first level of elasticity; wherein the non-terry garment region has a second level of elasticity that is greater than the first level of elasticity. In some embodiments, the terry garment-region has a first level of elasticity; wherein the non-terry garment region has a second level of elasticity that is smaller than the first level of elasticity.

In some embodiments, the terry garment-region provides a first level of body support; wherein the non-terry garment region has a second, different, level of body support. In some embodiments, the terry garment-region provides a first level of body support; wherein the non-terry garment region has a second, greater, level of body support. In some embodiments, the terry garment-region provides a first level of body support; wherein the non-terry garment region has a second, smaller, level of body support. In some embodiments, the terry garment-region provides a first level of warmth; wherein the non-terry garment region has a second, different, level of warmth. In some embodiments, the terry garment-region provides a first level of warmth; wherein the non-terry garment region has a second, greater, level of warmth. In some embodiments, the terry garment-region provides a first level of warmth; wherein the non-terry garment region has a second, smaller, level of warmth. In some embodiments, the terry garment-region provides a first level of temperature isolation from a surrounding environment; wherein the non-terry garment region has a second, different, level of temperature isolation from the surrounding environment.

In some embodiments, the terry garment-region provides a first level of temperature isolation from a surrounding environment; wherein the non-terry garment region has a second, smaller, level of temperature isolation from the surrounding environment. In some embodiments, the terry garment-region provides a first level of temperature isolation from a surrounding environment; wherein the non-terry garment region has a second, greater, level of temperature isolation from the surrounding environment. In some embodiments, the terry garment-region provides a first level of sweat and moisture absorption; wherein the non-terry garment region has a second, different, level of sweat and moisture absorption.

In some embodiments, the terry garment-region provides a first level of sweat and moisture absorption; wherein the non-terry garment region has a second, smaller, level of sweat and moisture absorption. In some embodiments, the terry garment-region provides a first level of sweat and moisture absorption; wherein the non-terry garment region has a second, greater, level of sweat and moisture absorption. In some embodiments, the terry garment-region provides a first level of sweat and moisture transport; wherein the non-terry garment region has a second, different, level of sweat and moisture transport.

In some embodiments, the terry garment-region provides a first level of sweat and moisture transport; wherein the non-terry garment region has a second, smaller, level of sweat and moisture transport. In some embodiments, the terry garment-region provides a first level of sweat and moisture transport; wherein the non-terry garment region has a second, greater, level of sweat and moisture transport. In some embodiments, the terry garment-region and the non-terry garment-region are formed of a same yarn.

In some embodiments, the terry garment-region and the non-terry garment-region are formed of a same type of yarn. In some embodiments, the terry garment-region is formed of a first yarn; and the non-terry garment-region is formed of a second, different, yarn. In some embodiments, the terry garment-region is formed of a first yarn; and the non-terry garment-region is formed of a second, lighter and/or thinner, yarn. In some embodiments, the terry garment-region is formed of a first yarn; and the non-terry garment-region is formed of a second, heavier and/or thicker, yarn. In some embodiments, the terry garment-region is formed of a first type of yarn; and the non-terry garment-region is formed of a second, different, type of yarn.

In some embodiments, the terry garment-region has a first thread-count per unit-of-area; wherein the non-terry garment-region has a second, different, thread-count per unit-of-area. In some embodiments, the terry garment-region has a first thread-count per unit-of-area; wherein the non-terry garment-region has a second, greater, thread-count per unit-of-area. In some embodiments, the terry garment-region has a first thread-count per unit-of-area; wherein the non-terry garment-region has a second, smaller, thread-count per unit-of-area.

In some embodiments, the terry garment-region and the non-terry garment-region are formed of a same yarn and have a same thread-count per unit-of-area. In some embodiments, the garment is a shirt; wherein the terry garment-region covers at least an armpit of the human wearer. In some embodiments, the garment is a shirt; wherein the terry garment-region covers at least a stomach of the human wearer.

In some embodiments, the garment is pants; wherein the terry garment-region covers at least a knee of the human wearer.

In some embodiments, the garment is a bra or a sports-bra; wherein the terry garment-region is or comprises a shoulder strap of said bra or sports-bra; or wherein the terry garment-region is only a portion of the shoulder strap which covers the shoulder of the human wearer.

In some embodiments, the garment is a bra or a sports-bra; wherein the terry garment-region is located underneath a cup of said bra or sports-bra.

In some embodiments, the garment is a bra or a sports-bra; wherein the terry garment-region covers a nipple of the human wearer and also covers some, but not all, of a breast of the human wearer.

In some embodiments, the garment is an underwear; wherein the terry garment-region is or comprises a gusset of said underwear.

In some embodiments, the terry garment-region is knitted facing inwardly relative to a human wearer, such that a towel or towel-like knitted fabric structure is facing inwardly towards the body of the human wearer, and not outwardly away from the human wearer. In some embodiments, the terry garment-region is knitted facing outwardly relative to a human wearer, such that a towel or towel-like knitted fabric structure is facing outwardly away from the body of the human wearer, and not inwardly towards the human wearer. In some embodiments, the terry garment-region is knitted facing both inwardly towards the human wearer and outwardly away from the human wearer, such that a towel or towel-like knitted fabric structure is facing both inwardly towards the body of the human wearer and outwardly away from the body of the human wearer.

Some embodiments include a continuous fabric (or a roll of fabric, or a batch of fabric) for making clothes, comprising: a terry fabric-region having terry-knit cloth, and a non-terry fabric-region having non-terry-knit cloth; wherein the terry fabric-region is directly bordering and adjacent to the non-terry fabric-region; wherein the terry fabric-region and the non-terry fabric-region are a seamless continuation of each other. In some embodiments, such continuous fabric has one or more of the features that are detailed above with regard to said garment.

In some embodiments, the garment or clothing article may incorporate one or more terry-cloth garment region(s), wherein each one of them may be a single-layer terry-knit fabric or a double-layer or dual-layer or double-thickness terry-knit fabric; and may optionally include, at such terry-cloth garment region(s) and/or at other (non-terry-cloth knitted garment-region(s)) other materials which may be added and/or embedded and/or injected and/or deposited and/or incorporated into and/or onto and/or within the knitted fabric(s) and/or the knitted garment-region(s), or portions or sub-regions thereof, in order to achieve a particular functionality of functional goal or functional property. Such additional material(s) may be added via a heat-press process, for example, by heat-pressing a combination of (i) the relevant garment-region's knitted fabric together with (ii) the added material(s) which are placed on top and/or beneath and/or inside (e.g., woven through) such knitted fabric.

For example, a bra or a sports bra or an activewear bra (e.g., for women, for teenagers, for any suitable age) may be knitted via a seamless knitting machine, and may include one or more particular terry-cloth region(s), having terry loops (e.g., similar to a towel, or to a fabric of a towel), having a single layer or two layers of terry loops or terry knit cloth; and also having an integral, seamlessly knitted, waist-band or back-band and/or shoulder straps. The terry-cloth regions and the terry loops may provide one or more advantages or functionalities; for example, to improve or enhance the breast support, to assist in keeping the breast held in place during physical exercise or walking or running or bending, to provide thermal insulation, to provide warmth (in some implementation) or air ventilation (in some other implementations), to provide breast shaping, to provide enhanced covering of the nipples for modesty purposes, and/or for other functionalities.

The additional material(s) that may be added, to terry-cloth garment-region(s) and/or to non-terry-cloth garment-region(s), may be for example: silicone polymer(s), polyvinyl chloride (PVC), flexible PVC, non-rigid PVC, elastic PVC, synthetic plastic polymer(s), flexible synthetic plastic polymer(s), elastic synthetic plastic polymer(s), thermoplastic polyurethane (TPU), flexible TPU, elastic TPU, three-dimensional (3D) printed TPU, three dimensional (3D) printed PVC, TPU foil, TPU film, deposited or injected TPU, deposited or injected PVC, deposited or injected polymers, deposited or injected synthetic plastic polymer(s); a combination or mixture of two or more of said materials; two or more layers, each layer having at least one of said materials; and/or other suitable combinations of said materials.

In some embodiments, the additional material(s) are bonded or glued or attached or fused, for example, in between two bra fabric layers (e.g., sandwiched between two bra layers); or, the additional material(s) may be external to the bra's most external fabric layer (e.g., being furthest away from the human body); or, the additional material(s) may be internal to the bra's most internal fabric layer (e.g., being closest to the human body). In some embodiments, such additional material(s) may be connected at a central-front region of the bra (or garment), and/or at a central-back or central-rear region of the bra (or garment), and/or at a particular side or region or element of the bra or garment (e.g., cup area, beneath the cup, over the cup, around the cup, surrounding the cup, between the cups, along the shoulder straps, along the back-strap, along the back region, adjacent to any wire if a wire is included, or the like).

In some embodiments, the garment or the bra may be a double layer item or a single layer item. In some embodiments, the double layer of fabric may encircle full 360 degrees all around the human body; or, in other embodiments, one of the two layers may cover and may encircle the human body at 360 degrees all around, whereas a second layer may cover only the front side or region, or only the back side or rear side, or only a particular region or set of regions (e.g., only the right-side and left-side regions). The layer or layers may be knitted seamlessly, including the waistband or back-strap; or, one of the layers and/or the waistband may be connected with other means, such as sewing or bonding or gluing or ultrasound fusion or other suitable methods.

In some embodiments, at least one of the fabric layer(s) may be warp knit fabric, or woven fabric, or may comprise PVC or TPU or leather, or other suitable material(s).

In some embodiments, a TPU element or layer may be injected or deposited or added or connected to or onto or into or beneath one or more particular garment-regions or bra-regions; for example, around the breast cups, and/or covering the breast cups, and/or below or beneath (e.g., vertically) the breast cups; and optionally, such TPU material(s) or element(s) may be placed or inserted between two fabric layers of the bra and may then be heat-pressed or heat-glued to become sandwiched or trapped within the bra layers; or, the TPU material(s) or element(s) may be 3D-printed or 3D-injected or 3D-deposited or 3D-coated in between the two bra layers by temporarily opening them and performing the insertion between them.

For example, a demonstrative method may include the following steps or operations: (a) open the knitted fabric tube, such as on the side of the bra or garment; (b) insert the fabric tube into the bottom plate of a heat press machine, without the waistband, with the left side tube facing upwardly; (c) provide and place the TPU or PVC or plastic-based element, and optionally fine-tune the placement or the positioning on the tube by using a template or a laser marker, and optionally start from the waist line body (without the waist); (d) cover with silicone paper or other suitable material or film or foil or divider, to prevent glue marks on the garment; (e) activate or operate the heat press machine to perform the heat press process; for example, in a demonstrative embodiments, an actual temperature measured by external wire thermometer may be 180 or 190 or 200 degrees Celsius, the cycle time may be 20 or 25 or 30 seconds, and the pressure may be 5 or 6 bar; (f) after finishing the above operations, peel-off or remove the silicone paper, immediately or optionally after allowing the garment to cool down for 5 to 10 minutes. In some embodiments, the bra may be molded; or may be produced using a mold or template. The fabric tube may be cut according to a suitable or pre-defined cutting line, and both layers of fabric may be sewn to each other, or may be bonded or glued to each other in other suitable process.

In some embodiments, a TPU element and/or a PVC element, or a flexible TPU element or a flexible PVC element, is inserted or is sandwiched between two fabric-layers, and such combination is then heat-pressed. In other embodiments, a TPU element and/or a PVC element, or a flexible TPU element or a flexible PVC element, is placed on top or beneath a single fabric layer, and then they are heat pressed, and then a second fabric layer is added and is heat-pressed (or glued or bonded otherwise) to create the sandwiched garment. Other suitable production methods may be used.

In some embodiments, the one or more additional material(s) or element(s) may have suitable 3D shapes and/or structure(s) to achieve one or more functionalities; for example, they may be structured to provide breast lifting or breast support or breast push-up, and/or to provide breast holding or reduced-bounce or to eliminate bounce.

Reference is made to FIGS. 9A-9D, which are illustrations of several sports bras in accordance with some demonstrative embodiments.

Figure 9A:
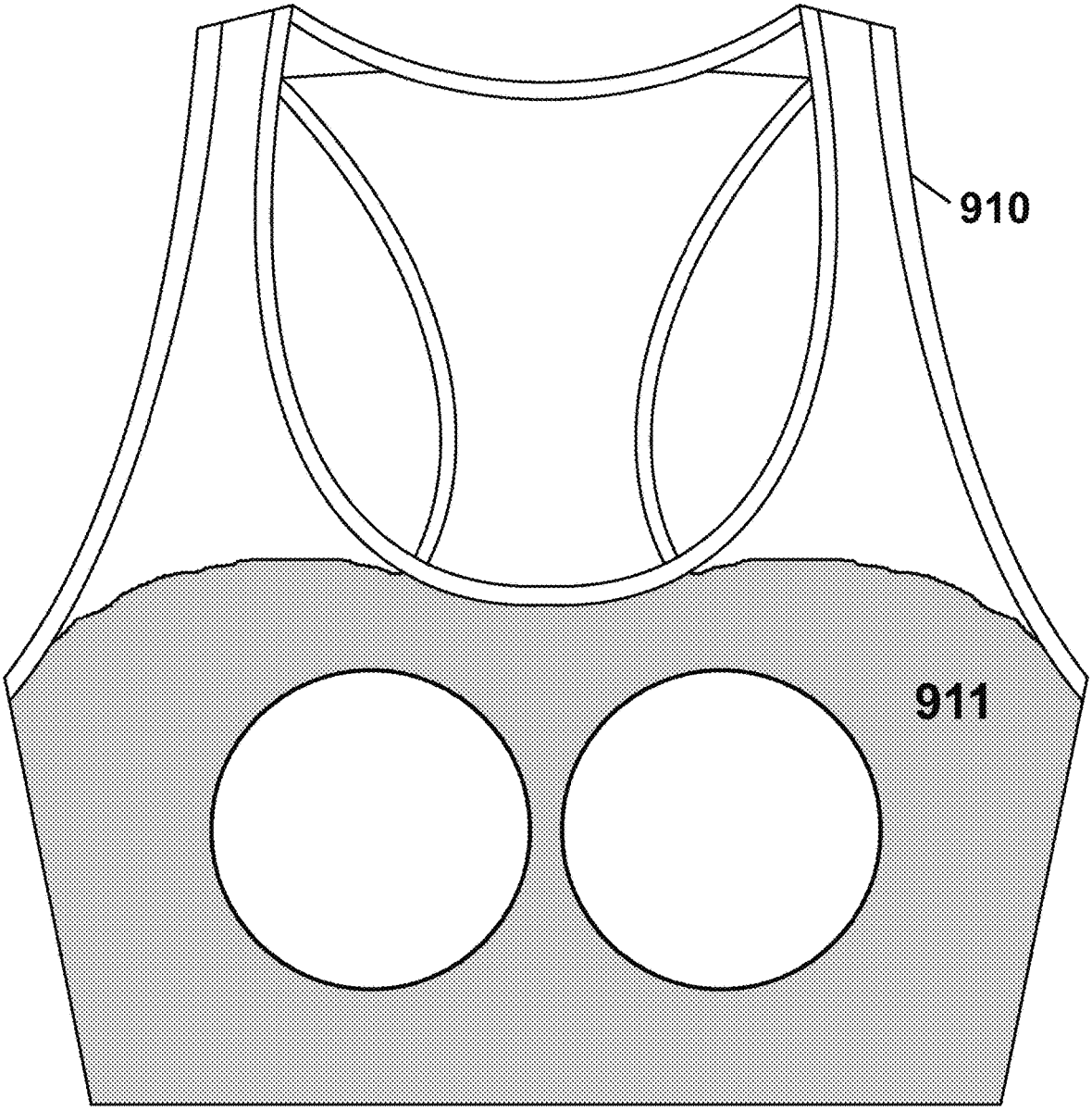
FIGS. 9A-9D are illustrations of several sports bras, in accordance with some demonstrative embodiments of the present invention.

As demonstrated in FIG. 9A, a sports bra 910 may have TPU and/or PVC element(s) within garment-region 911 (indicated in gray) which may surround the breast cups. Such structure may provide push-up to the breasts, or may assist in holding their in place and reducing breast bounce or breast movement relative to the wearer's body, while also providing room and comfortable feeling to the breasts themselves.

Figure 9B:
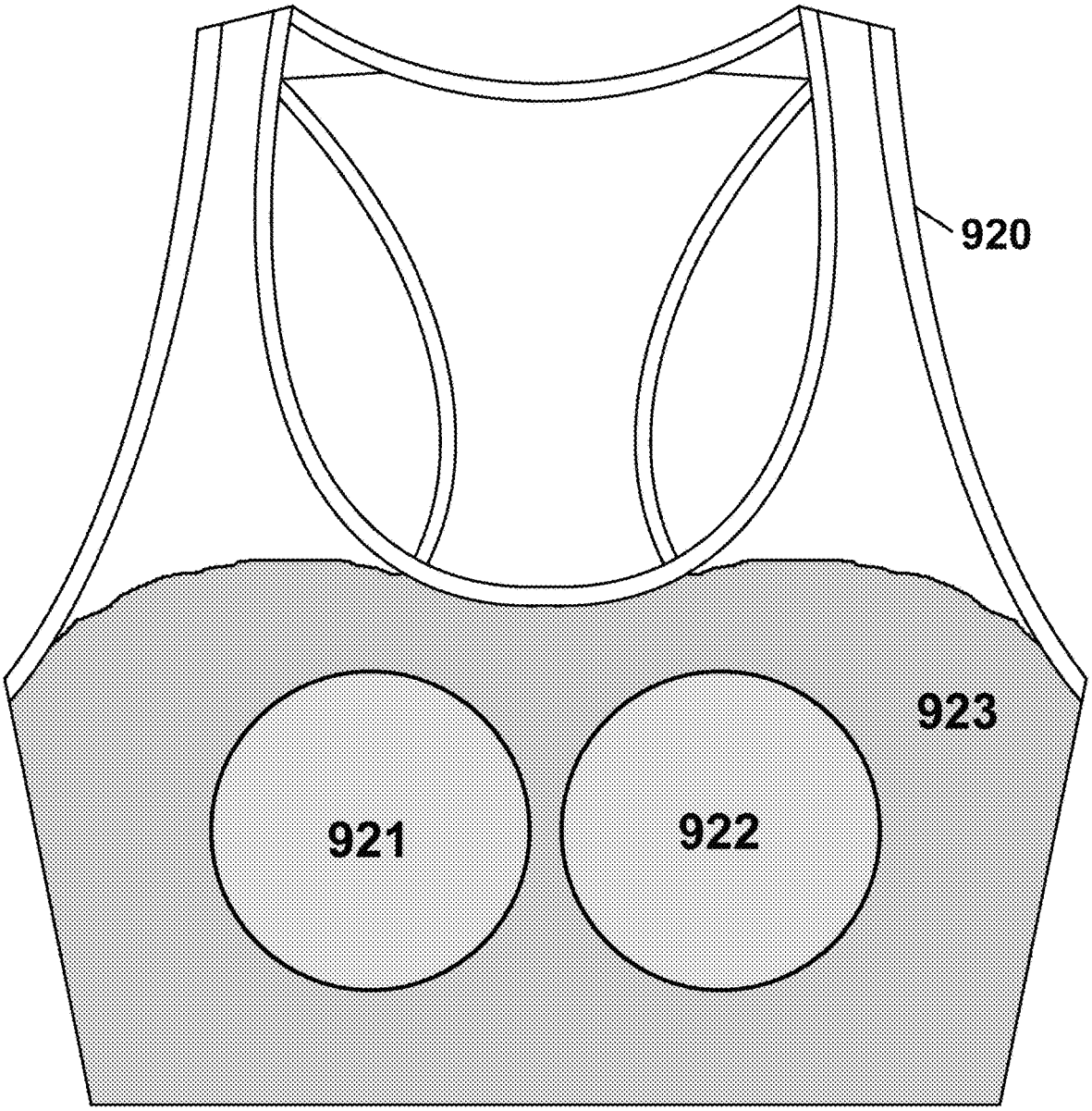

As demonstrated in FIG. 9B, a sports bra 920 may have TPU and/or PVC element(s) within garment-regions 921-923 (indicated in gray) which may surround the breast cups and may further include the breast cups themselves. Such structure may provide high-impact and no-bounce effect to the breasts.

Figure 9C:
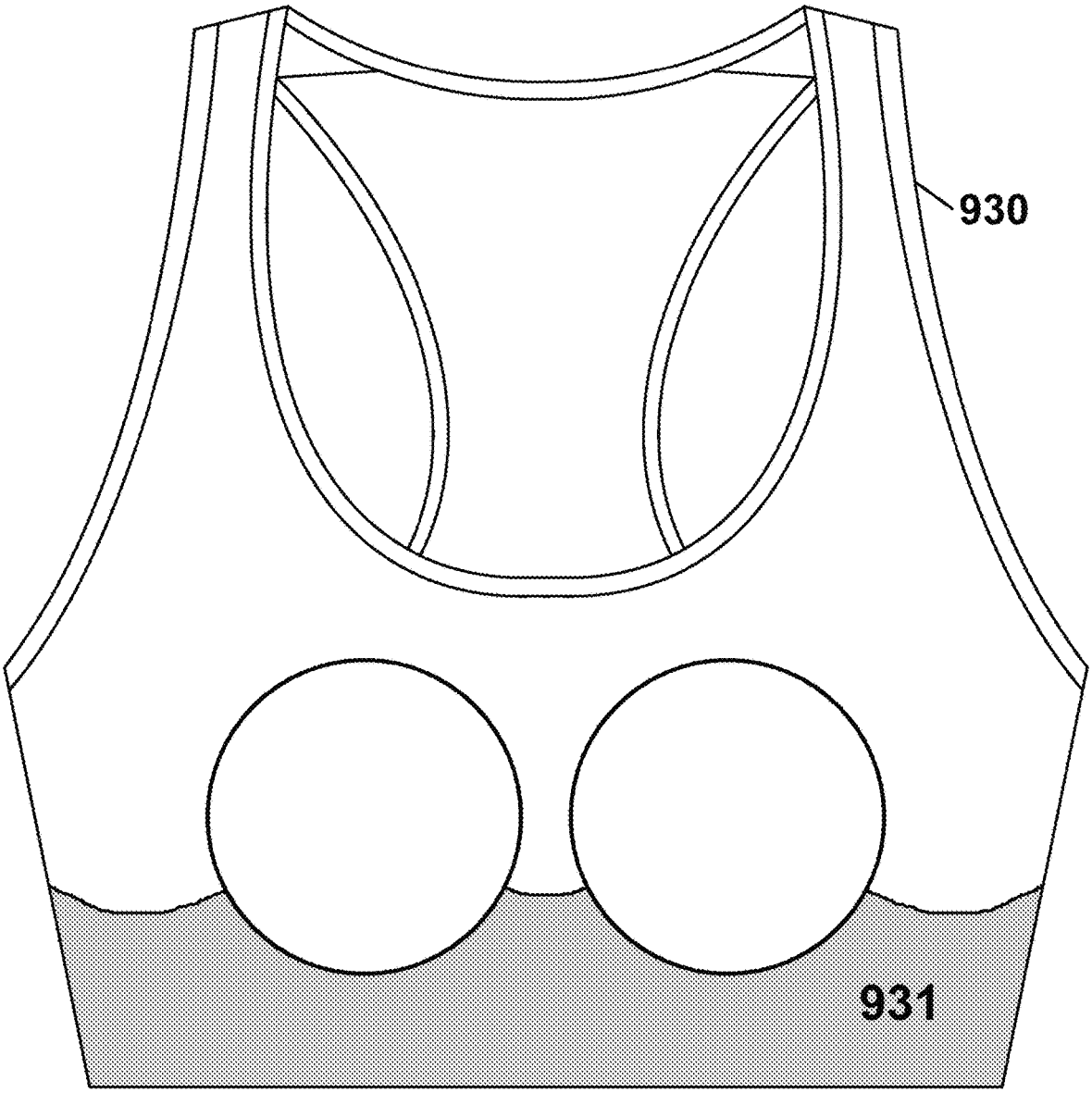

As demonstrated in FIG. 9C, a sports bra 930 may have TPU and/or PVC element(s) within garment-region 931 (indicated in gray) which may be beneath the breast cups. Such structure may provide or may improve breast-holding functionality of the bra.

Figure 9D:
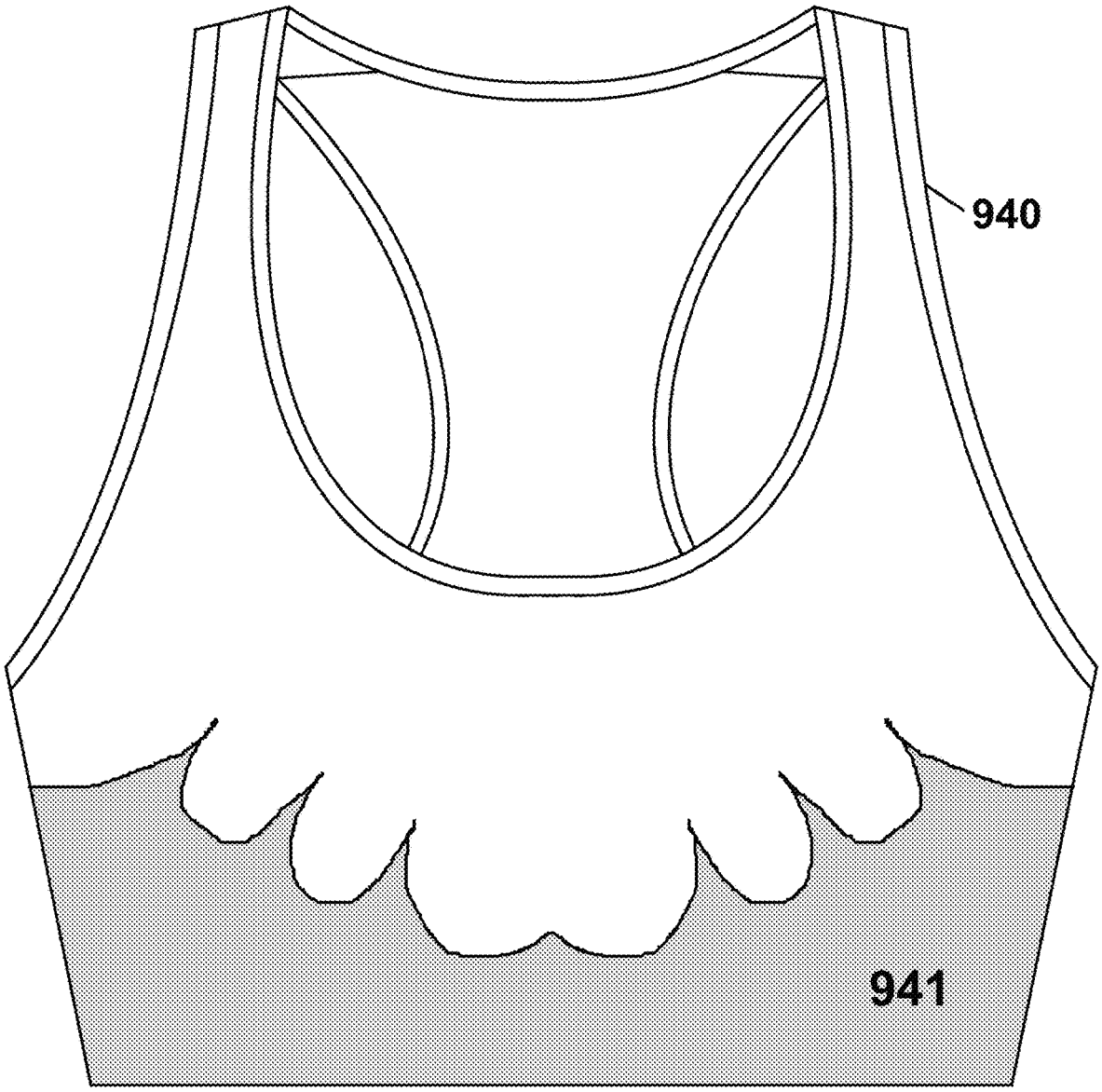

As demonstrated in FIG. 9D, a sports bra 940 may have TPU and/or PVC element(s) within garment-region 941 (indicated in gray) which may be beneath the breast cups and may include convex or concave sub-regions or a curved pattern as demonstrated. Such structure may provide or may improve breast-holding functionality of the bra.

Other suitable structures may be used in accordance with some embodiments.

In some embodiments, TPU and/or PVC material(s) and/or element(s) are sandwiched or trapped or enclosed or heat-pressed or glued or bonded within two terry-cloth fabric layers of the garment (e.g., the bra or the sports bra), or between two terry-knit fabric layers of the garment (e.g., the bra or the sports bra). In some embodiments, additionally or alternatively TPU and/or PVC material(s) and/or element(s) are sandwiched or trapped or enclosed or heat-pressed or glued or bonded within two non-terry-cloth fabric layers of the garment (e.g., the bra or the sports bra), or between two non-terry-knit fabric layers of the garment (e.g., the bra or the sports bra). Additionally or alternatively, in some embodiments, TPU and/or PVC material(s) and/or element(s) are sandwiched or trapped or enclosed or heat-pressed or glued or bonded within a terry-cloth fabric layer and a non-terry-cloth fabric layer of the same garment (e.g., the bra or the sports bra), or between a terry-knit fabric layer and a non-terry-knit fabric layer of the same garment (e.g., the bra or the sports bra).

In some embodiments, the terry garment-region comprises: a layer of towel-like knitted fabric structure; that covers, or that is covered by, a non-planar layer of injection-molded plastic.

In some embodiments, the terry garment-region comprises: a layer of towel-like knitted fabric structure; that covers, or that is covered by, a non-planar layer of injection-molded polyvinyl chloride (PVC).

In some embodiments, the terry garment-region comprises: a layer of towel-like knitted fabric structure; that covers, or that is covered by, a non-planar layer of thermoplastic polyurethane (TPU).

In some embodiments, the terry garment-region comprises: (a) a first layer of towel-like knitted fabric structure, (b) a second layer of towel-like knitted fabric structure, (c) a non-planar layer of injection-molded plastic, that is sandwiched between the first layer of towel-like knitted fabric structure and the second layer of towel-like knitted fabric structure.

In some embodiments, wherein the terry garment-region comprises: (a) a first layer of towel-like knitted fabric structure, (b) a second layer of towel-like knitted fabric structure, (c) a non-planar layer of injection-molded polyvinyl chloride (PVC), that is sandwiched between the first layer of towel-like knitted fabric structure and the second layer of towel-like knitted fabric structure.

In some embodiments, the terry garment-region comprises: (a) a first layer of towel-like knitted fabric structure, (b) a second layer of towel-like knitted fabric structure, (c) a non-planar layer of thermoplastic polyurethane (TPU), that is sandwiched between the first layer of towel-like knitted fabric structure and the second layer of towel-like knitted fabric structure.

In some embodiments, the terry garment-region further comprises one or more thermoplastic polyurethane (TPU) elements embedded therein.

In some embodiments, the terry garment-region further comprises one or more polyvinyl chloride (PVC) elements embedded therein.

In some embodiments, the non-terry garment-region comprises at least one sub-region that is formed of knitted fabric and that has one or more thermoplastic polyurethane (TPU) elements embedded therein.

In some embodiments, the non-terry garment-region comprises at least one sub-region that is formed of knitted fabric and that has one or more polyvinyl chloride (PVC) elements embedded therein.

In some embodiments, the garment is a bra or a sports bra; wherein at least one of the following garment-regions is formed of knitted fabric having one or more polyvinyl chloride (PVC) elements embedded therein: a garment-region that surrounds a breast cup, a garment-region that is located beneath a breast cup.

In some embodiments, the garment is a bra or a sports bra; wherein at least one of the following garment-regions is formed of knitted fabric having one or more thermoplastic polyurethane (TPU) elements embedded therein: a garment-region that surrounds a breast cup, a garment-region that is located beneath a breast cup.

Some embodiments provide a continuous and seamless knitted fabric, comprising: a terry fabric-region having terry-knit cloth, and a non-terry fabric-region having non-terry-knit cloth; wherein the terry fabric-region is directly bordering and adjacent to the non-terry fabric-region; wherein the terry fabric-region and the non-terry fabric-region are a seamless knit continuation of each other; wherein the terry fabric-region and the non-terry fabric-region are located on a same plane; wherein the terry fabric-region is a continuous knitted fabric that continues the adjacent non-terry fabric-region; wherein the terry fabric-region is a non-patched non-stitched portion of said fabric, and wherein said fabric is patch-less and lacks any patches; wherein the terry fabric-region is surrounded, from all its sides, by the non-terry fabric-region; wherein the terry fabric-region is a direct knitted seamless continuation of the non-terry fabric-region. In some embodiments, the terry fabric-region and the non-terry fabric-region are a single layer of fabric; wherein the terry fabric-region is neither over nor under the non-terry fabric-region; wherein the terry fabric-region does not cover the non-terry fabric-region; wherein the non-terry fabric-region does not cover the terry fabric-region.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A garment for a human wearer, the garment comprising:
a terry garment-region having terry-knit cloth, and
a non-terry garment-region having non-terry-knit cloth;
wherein the terry garment-region is directly bordering and adjacent to the non-terry garment-region;
wherein the terry garment-region and the non-terry garment-region are a seamless knit continuation of each other;
wherein the terry garment-region and the non-terry garment-region are located on a same plane;
wherein the terry garment-region is a continuous knitted fabric that continues the adjacent non-terry garment-region;
wherein the terry garment-region is a non-patched non-stitched portion of said garment, and wherein said garment is patch-less and lacks any patches;
wherein the terry garment-region is surrounded from all sides by the non-terry garment-region;
wherein the terry garment-region is a direct knitted seamless continuation of the non-terry garment region.

2. The garment of claim 1,
wherein the terry garment-region and the non-terry garment-region are a single layer of fabric;
wherein the terry garment-region is neither over nor under the non-terry garment-region,
wherein the terry garment-region does not cover the non-terry garment-region, and
wherein the non-terry garment-region does not cover the terry garment-region.

3. The garment of claim 1,
wherein the terry garment-region has a first thickness; and
wherein the non-terry garment region has a second thickness that is smaller than the first thickness.

4. The garment of claim 1,
wherein the terry garment-region has a first level of rigidity; and
wherein the non-terry garment region has a second level of rigidity that is smaller than the first level of rigidity.

5. The garment of claim 1,
wherein the terry garment-region has a first level of elasticity; and
wherein the non-terry garment region has a second level of elasticity that is greater than the first level of elasticity.

6. The garment of claim 1,
wherein the terry garment-region provides a first level of body support; and
wherein the non-terry garment region has a second, different, level of body support.

7. The garment of claim 1,
wherein the terry garment-region provides a first level of warmth; and
wherein the non-terry garment region has a second, different, level of warmth.

8. The garment of claim 1,
wherein the terry garment-region provides a first level of temperature isolation from a surrounding environment; and
wherein the non-terry garment region has a second, different, level of temperature isolation from the surrounding environment.

9. The garment of claim 1,
wherein the terry garment-region provides a first level of sweat and moisture absorption; and
wherein the non-terry garment region has a second, different, level of sweat and moisture absorption.

10. The garment of claim 1,
wherein the terry garment-region provides a first level of sweat and moisture transport; and
wherein the non-terry garment region has a second, different, level of sweat and moisture transport.

11. The garment of claim 1,
wherein the terry garment-region and the non-terry garment-region are formed of a same single yarn which continues seamlessly from the non-terry garment-region to the terry garment region and which also continues seamlessly from the terry garment-region to the non-terry garment-region.

12. The garment of claim 1,
wherein the terry garment-region is formed of a first yarn; and
wherein the non-terry garment-region is formed of a second, different, yarn.

13. The garment of claim 1,
wherein the terry garment-region is formed of a first type of yarn; and
wherein the non-terry garment-region is formed of a second, different, type of yarn.

14. The garment of claim 1,
wherein the terry garment-region has a first thread-count per unit-of-area; and
wherein the non-terry garment-region has a second, different thread-count per unit-of-area.

15. The garment of claim 1,
wherein the terry garment-region is knitted facing inwardly relative to the human wearer; and
wherein at said terry garment-region, a towel knitted fabric structure is facing inwardly towards the human wearer and not outwardly away from the human wearer.

16. The garment of claim 1,
wherein the terry garment-region is knitted facing outwardly relative to the human wearer; and
wherein at said terry garment-region, a towel knitted fabric structure is facing outwardly away from the human wearer and not inwardly towards the human wearer.

17. The garment of claim 1,
wherein the terry garment-region comprises:
a layer of towel knitted fabric structure,
that covers, or that is covered by,
a non-planar layer of injection-molded plastic.

18. The garment of claim 1,
wherein the terry garment-region comprises:
a layer of towel knitted fabric structure,
that covers, or that is covered by,
a non-planar layer of injection-molded polyvinyl chloride (PVC).

19. The garment of claim 1,
wherein the terry garment-region comprises:
a layer of towel knitted fabric structure,
that covers, or that is covered by,
a non-planar layer of thermoplastic polyurethane (TPU).

20. The garment of claim 1,
wherein the terry garment-region comprises:
(a) a first layer of towel knitted fabric structure,
(b) a second layer of towel knitted fabric structure,
(c) a non-planar layer of injection-molded plastic, that is sandwiched between the first layer of towel knitted fabric structure and the second layer of towel knitted fabric structure.

21. The garment of claim 1,
wherein the terry garment-region comprises:
(a) a first layer of towel knitted fabric structure,
(b) a second layer of towel knitted fabric structure,
(c) a non-planar layer of injection-molded polyvinyl chloride (PVC), that is sandwiched between the first layer of towel knitted fabric structure and the second layer of towel knitted fabric structure.

22. The garment of claim 1,
wherein the terry garment-region comprises:
(a) a first layer of towel knitted fabric structure,
(b) a second layer of towel knitted fabric structure,
(c) a non-planar layer of thermoplastic polyurethane (TPU), that is sandwiched between the first layer of towel knitted fabric structure and the second layer of towel knitted fabric structure.

23. The garment of claim 1,
wherein the terry garment-region further comprises one or more thermoplastic polyurethane (TPU) elements embedded therein.

24. The garment of claim 1,
wherein the terry garment-region further comprises one or more polyvinyl chloride (PVC) elements embedded therein.

25. The garment of claim 1,
wherein the non-terry garment-region comprises at least one sub-region that is formed of knitted fabric and that has one or more thermoplastic polyurethane (TPU) elements embedded therein.

26. The garment of claim 1,
wherein the non-terry garment-region comprises at least one sub-region that is formed of knitted fabric and that has one or more polyvinyl chloride (PVC) elements embedded therein.

27. The garment of claim 1,
wherein the garment is a bra or a sports bra;
wherein at least one of the following garment-regions is formed of knitted fabric having one or more polyvinyl chloride (PVC) elements embedded therein:
a garment-region that surrounds a breast cup, and
a garment-region that is located beneath a breast cup.

28. The garment of claim 1,
wherein the garment is a bra or a sports bra;
wherein at least one of the following garment-regions is formed of knitted fabric having one or more thermoplastic polyurethane (TPU) elements embedded therein:
a garment-region that surrounds a breast cup, and
a garment-region that is located beneath a breast cup.

29. The garment of claim 1,
wherein the garment is a bra or a sports-bra; and
wherein the terry garment-region is or comprises a shoulder strap of said bra or sports-bra.

30. The garment of claim 1,
wherein the garment is a bra or a sports-bra; and
wherein the terry garment-region is located underneath a cup of said bra or sports-bra.

31. The garment of claim 1,
wherein the garment is a bra or a sports-bra; and
wherein the terry garment-region covers a nipple of the human wearer and also covers some, but not all, of a breast of the human wearer.

* * * * *